United States Patent [19]

Patterson, Jr. et al.

[11] Patent Number: 4,515,727

[45] Date of Patent: May 7, 1985

[54] ALLENE CONTAINING ARACHIDONIC ACID DERIVATIVES

[75] Inventors: John W. Patterson, Jr., Mountain View; Jurg R. Pfister, Los Altos, both of Calif.

[73] Assignee: SYNTEX (U.S.A.) Inc., Palo Alto, Calif.

[21] Appl. No.: 434,206

[22] Filed: Oct. 13, 1982

[51] Int. Cl.[3] ..... C11C 1/00

[52] U.S. Cl. ..... 260/413; 260/410.9 R

[58] Field of Search ..... 260/410.9 M, 413 L

[56] References Cited

U.S. PATENT DOCUMENTS

| | | | |
|---|---|---|---|
| 2,928,854 | 3/1960 | Bolhofer | 260/413 L |
| 2,934,570 | 4/1960 | Goldberg et al. | 260/413 L X |
| 3,291,816 | 12/1966 | Goldblatt et al. | 260/410.9 M |
| 3,356,699 | 12/1967 | Bagby et al. | 260/413 L X |
| 3,405,151 | 10/1968 | Pike | 260/413 L X |
| 3,450,821 | 6/1969 | Carstensen et al. | 260/413 L X |
| 3,716,565 | 2/1973 | Henrick et al. | 260/410.9 M |
| 3,824,262 | 7/1974 | Heslinga et al. | 260/413 L X |
| 3,972,907 | 8/1976 | Baran et al. | 260/413 L |
| 3,978,100 | 8/1976 | Fujita et al. | 260/410.9 M |
| 4,107,193 | 8/1978 | Kijima et al. | 260/413 L X |

*Primary Examiner*—Helen M. S. Sneed

*Attorney, Agent, or Firm*—James M. Kanagy; Tom M. Moran

[57] ABSTRACT

Disclosed herein are novel allene-containing compounds of the formula

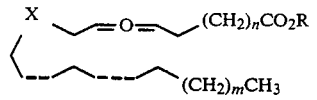

I wherein R is hydrogen, alkyl of 1 to 6 carbon atoms or a pharmaceutically acceptable salt; X is CH=CH, $OCH_2$, $CH_2O$, $CH_2S$, $SCH_2$, O or S; n is 1 or 2 but is 1 when X is CH=CH; m is 0-6; and the dotted lines represent a single or double bond. These compounds mediate leukotriene-caused physiological changes in mammals.

13 Claims, No Drawings

ALLENE CONTAINING ARACHIDONIC ACID DERIVATIVES

BACKGROUND OF THE INVENTION

1. Scope of the Invention

This application relates to novel arachidonic acid derivatives which contain an allene group. More specifically it relates to leukotriene mediating compounds which are allene containing derivatives of arachidonic acid which may also contain chain substituted sulfur or oxygen.

2. Related Art

Australian researchers Kellaway and Trethewie in 1940 described a myotropic substance which was released from the lung during anaphylaxis and could possibly account for some of the anaphylactic symptoms. Studies of purified but unidentified material on guinea pig jejunum demonstrated that the material had a slow contracting effect on smooth muscle. Because of this, the unidentified material was called slow reacting smooth-muscle-stimulating substance (SRS).

The substance resisted identification for many years and it was not until the development of liquid chromatographic separation techniques that it became possible to determine the structure of SRS. In the intervening years between the discovery of SRS and its identification, a goodly number of pharmacological studies were carried out which indicated or suggested that SRS was released during allergic reactions and produces many of the effects experienced by afflicted individuals. Initially the myotropic material released by the lung during anaphalaxis was designated SRS-A to differentiate substance produced by the lungs upon immunological challenge by specific antigens from those generated upon non-immunological stimulation. However, subsequent studies have shown SRS-A and SRS to be one and the same material.

Beginning in the late 60's and continuing into the early 70's much new information was developed on the biochemistry of arachadonic acid, particularly with the successive findings of prostaglandin endoperoxides, thromboxanes and prostacyclin. A recent additive to this list of oxygenated arachadonic acid metalolites are the leukotrienes first described by Borgeat and Samuelsson. These metabolites were named leukotrienes because of their origin from leukocytes and the presence of a conjugated triene. The interest in leukotrienes gained momentum when it was discovered that an SRS substance was a leukotriene.

Early studies into the biosynthesis of arachadonic acid into leukotrienes was carried out by Borgeat, Samuelsson and colleagues, first reported in 1979. These researchers determined that arachadonic acid is converted to a five perhydroxy acid by means of a novel lipoxygenase-type reaction which is seen only in the leukocyte. The disposition of this 5-hydroperoxy acid was determined to be a reduction to the 5-hydroxy acid by a reductase. The second and most important step is that wherein the 5-hydroperoxy acid undergoes loss of water to give a compound known as leukotriene $A_4$ determined by E. J. Corey to be (±)-5,6-oxido-7,9-trans-11,14-cis-eicosatetraenoic acid. Prior to the discovery of this unstable epoxide matabolite, Borgeat and colleagues reported the biosynthesis of a 5(S)-hydroxy-6,8,11,14-eicosatetraenoic acid and 8(S)-hydroxy-9,11,14-eicosatrienoic acid in rabbit peritoneal polymorphonuclear leukocytes (PMNL). An 8,11,14-eicosatrienoic acid also derived from arachadonic acid was reported in this study. Subsequent to this work Borgeat, et al reported the discovery of an arachadonic acid metabolite, the 5-(S),12(R)-dihydroxy-6,8,10,14-eicosatetraenoic acid, subsequently named leukotriene $B_4$. Still further research by Borgeat and Samuelsson determined the structures of minor metabolites of arachadonic acid in PMNL which were 5,6-dihydroxy-7,9,11,14-eicosatetranoic acids (epimers at C-6) and at 2 geometric isomers of leukotriene $B_4$ (epimers at C-12).

The broader significance of this newly discovered arachadonic acid biosynthetic pathway was brought to light when B. Samuelsson and R. C. Murphy separately reported that SRS was a leukotriene. With the advent of high pressure liquid chromatography it became possible to purify samples of SRS-A sufficiently so that they could be spectrally characterized. Morris et al, reported that the ultraviolet spectrum of a highly purified SRS-A sample showed the characteristic absorption bands of leukotrienes. At about the same time studies by B. A. Jakschik, et al and P. Sirois, et al suggested a precursor of arachadonic acid in the synthesis of SRS-A. Previous studies had already shown that the ionophore A23187 stimulated the release of SRS from leukocytes and of SRS-A from perfused lungs. It was also known that, under certain conditions, the cyclooxygenase inhibitors indomethacin and aspirin could stimulate the release of SRS-A. Such data reasonably indicated a relationship between SRS-A and leukotrienes because leukotrienes are metabolites of arachadonic acid in leukocytes, the synthesis of the 5-hydroxy acid is not inhibited by indomethacin, the ionophore A23187 is known to be a powerful stimulator for the transformation of arachadonic acid into leukotriene $B_4$ in human PMNL, and the conjugated triene is a structural characteristic of leukotrienes.

There was also evidence that SRS and SRS-A were sulfur containing compounds. This supposition rested in the observation that many thiols and particularly cysteine stimulated the formation of SRS and SRS-A. Leukotriene $A_4$, the epoxide was expected to react easily with nucleophiles such as thiols and alcohols. Sulfur labeling experiments where SRS was produced from mastocytoma cells incubated with arachadonic acid, L-cysteine, and ionophore A23187 determine that SRS incorporated cysteine and arachadonic acid. Chemical analysis of this SRS material revealed that the compound was a 5-hydroxy-7,9,11,14-eicosatetraenoic acid carrying a thioether linked substituent at C-6.

Hammarstrom, et al subsequently identified the C-6 substituent in mouse mastocytoma cells SRS as glutathione. This SRS material was determined to be 5(S)-hydroxy-6(R)-S-glutathionyl-7,9-trans,11,14-cis-eicosatetraenoic acid, now recognized to be leukotriene $C_4$. Glutathione is a tripeptide comprising cysteine, glycine and glutamic acid.

SRS is also known to contain a large amount of another muscle contractant which is even more active than leukotriene $C_4$. Research into this area by Morris, et al using an SRS material obtained from rat basophil leukemia cells determined the presence of a cysteinylglycinyl conjugate of leukotriene $A_4$, a 5-hydroxy-6-S-cysteinylglycinyl-7,9,11,14-eicosatetraenoic acid. This compound was given the name leukotriene $D_4$. These same investigators demonstrated that leukotriene $D_4$ could be prepared by the action. Of gamma-glutamyl transpeptidase on leukotriene $C_4$. Additional work by Bach, et al, and Morris, et al confirmed that the SRS-A released upon immunological challenge of sensitized guinea pig lungs was identical with the SRS released by the rat basophil leukemia cells.

The distribution of leukotrienes and the biological significance of these compounds has not been fully elucidated to date. Such compounds have been identified in various leucocytes, mast cells, tumors, and lungs but the question still is unanswered as to whether or not these compounds are generally distributed throughout cells like prostaglandins or are limited to cells and tissues more directly involved with allergic reactions. There is tentative speculation that leukotrienes have a broad distribution based on the fact known leukotrienes are found in four different sources and that SRS substances chemically and biologically similar to leukotrienes have been located in many other tissues such as human skin, human nasal polyps, blood vessels, heart, and cat paw, and in a number of other species. However, to date the data from studies in this area do not establish which cell type is tied in with a source of leukotrienes. Immunological challenge does release these substances, therefore suggesting that cells carrying receptors for immunoglobulins E (or G for the guinnea pigs) are likely involved.

Understanding of the biological activity of these materials at this time is based primarily on knowledge generated from studies on SRS and SRS-A. These studies clearly point out the importance of SRS-A in immediate hypersensitivity reactions. Because of the importance of immediate hypersensitivity reactions in medicine, these compounds probably will have biological importance in determining the role of and in treating allergy, anaphylaxis, asthma and other conditions of a similar physiological bases.

The elucidation of the metabolic transformation of arachidonic acid into leukotrienes and their involvement in immediate hypersensitivity reactions provides the jumping off point for a better understanding of the mechanism behind the onset of such diseases as asthma and other diseases attributed or attributable to SRS-A material. With this information, a scientific approach to the treatment of asthma and SRS related problems can be substituted for the imperical approach which has in the past primarily characterized the development of drugs and treatment of such reactions.

With this understanding of the biosynthesis of leukotrienes it is now possible to design treatment regimes to treat immediate hypersensitivity reactions by effecting the synthetic pathway for peptide substituted leukotrienes. Because the biosynthetic pathway comprises a series of enzymatic reactions, it may be possible that drugs can be used to block or influence one or more of these enzymatic reactions. For example, it is known that clinical steroids block the release of arachidonic acid from phospholipids by blocking phospholipase activity. Nonsteroid anti-inflammatory drugs such as aspirin and indomethacin block the cyclooxygenase pathway leading to prostaglandins, thromboxanes and prostacyclin. Another possible approach to the control of leukotriene biosynthesis could be the use of "false-substrates" which would enter the lypoxygenase pathway and be transformed by the enzyme, but could not lead to the formation of active leukotrienes. This latter area is the focus of this invention. Allene containing arachidonic acid derivatives have been developed which can act as false substrates effecting the formation of 5-hydroperoxy acid and thereby mediating an immediate hypersensitivity reaction caused by leukotrienes. In addition the subject compounds may be used to treat inflammatory disease by virtue of their ability to regulate formation of 5-H PETE, the biosynthetic precursor of leukotriene $B_4$ which as a chemotactic and chemokinetic agent, effects release of lysomal enzymes and increases cyclic nucleotide levels, all key features of cellular inflammation.

SUMMARY OF THE INVENTION

This invention discloses 4,5 or 5,6-diene containing derivatives of arachidonic acid which have the following general formula

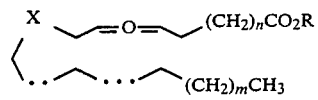

I wherein R is hydrogen, an alkyl group of 1–6 carbon atoms or a pharmaceutically acceptable salt; X is —CH=CH—, —$CH_2O$—, —$OCH_2$— —$CH_2S$—, —$SCH_2$—, S or O; n is 1 or 2 but is 1 when X is —CH=CH—; m is 0–6; and the dotted lines represent a single or double bond.

In another instance this invention relates to a composition comprising a compound of Formula I in admixture with a pharmaceutically acceptable excipient.

In yet another instance, this invention relates to a method for treating immediate hypersensitivity reaction or inflammation in a mammal which method comprises administering an effective amount of a compound of Formula I to a mammal either alone or in admixture with a pharmaceutically acceptable excipient.

Additionally, this invention relates to process for preparing a compound of the formula

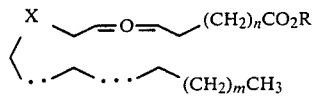

I wherein R is hydrogen, an alkyl group of 1–6 carbon atoms or a pharmaceutically acceptable salt; X is —CH=CH—, —$CH_2O$—, —$OCH_2$—, —$SCH_2$—, —$CH_2S$—, S or O; n is 1 or 2 but is 1 when X is —CH=CH—; m is 0–6; and the dotted lines represent a single or double bond which process comprises:

(1) converting a compound of the formula

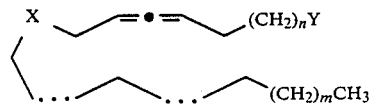

I(a)

wherein Y is halo and X, n, m and the dotted lines are as defined above, to the carboxylic acid by a carboxylic acid forming reaction; or (2) esterifying a compound of Formula I wherein R is hydrogen; or (3) converting an ester of Formula I wherein R is alkyl of 1–6 carbon atoms to another ester wherein R is alkyl of 1–6 carbon atoms; or (4) converting a compound of Formula I wherein R is hydrogen to a pharmaceutically acceptable salt; or (5) converting an ester of Formula I to an acid;

(6) Converting an ester of Formula I to a salt; or (7) converting a salt of Formula I to another salt.

Administration of the active compounds and salts described herein can be via any of the accepted modes of administration for agents which effect systemic reaction such as those involved in immediate hypersensitivity reaction or similar physiological conditions or for prevention of inflammation. These methods include oral, parenteral and otherwise systemic or aerosol forms.

Depending on the intended mode of administration, the compositions used may be in the form of solid, semi-solid or liquid dosage forms, such as, for example, tablets, suppositories, pills, capsules, powders, liquids, suspensions, or the like, preferably in unit dosage forms suitable for single administration of precise dosages. The compositions will include a conventional pharmaceutical carrier or excipient and an active compound of Formula I or the pharmaceutically acceptable salts thereof and, in addition, may include other medicinal agents, pharmaceutical agents, carriers, adjuvants, etc.

Parenteral administration is generally characterized by injection, either subcutaneously, intramuscularly or intravenously. Injectables can be prepared in conventional forms, either as liquid solutions or suspensions, solid forms suitable for solution or suspension in liquid prior to injection, or as emulsions. Suitable excipients are, for example, water, saline, dextrose, glycerol, ethanol or the like. In addition, if desired, the pharmaceutical compositions to be administered may also contain minor amounts of non-toxic auxiliary substances such as wetting or emulsifying agents, pH buffering agents and the like, such as for example, sodium acetate, sorbitan monolaurate, triethanolamine oleate, etc.

For systemic administration via suppository, traditional binders and carriers include, e.g. polyalkalene glycols or triglycerides. Such suppositories may be formed from mixtures containing active ingredient in the range of 0.5%–10%; preferably 1–2%.

For aerosol administration, the active ingredient is preferably supplied in finely divided form along with a surfactant and a propellant. Typical percentages of active ingredients are 0.01 to 20% by weight, preferably 0.04 to 1.0%.

Surfactants must, of course, be non-toxic, and preferably soluble in the propellant. Representative of such agents are the esters or partial esters of fatty acids containing from 6 to 22 carbon atoms, such as caproic, octanoic, lauric, palmitic, stearic, linoleic, linolenic, olestearic and oleic acids with an aliphatic polyhydric alcohol or its cyclic anhydride such as, for example, ethylene glycol, glycerol, erythritol, arabitol, mannitol, sorbitol, the hexitol anhydrides derived from sorbitol (the sorbitan esters sold under the trademark "Spans") and the polyoxyethylene and polyoxypropylene derivatives of these esters. Mixed esters, such as mixed or natural glycerides may be employed. The preferred surface-active agents are the oleates or sorbitan, e.g., those sold under the trademarks "Arlacel C" (Sorbitan sesquioleate), "Span 80" (sorbitan monooleate) and "Span 85" (sorbitan trioleate). The surfactant may constitute 0.1–20% by weight of the composition, preferably 0.25–5%.

The balance of the composition is ordinarly propellant. Liquefied propellants are typically gases at ambient conditions, and are condensed under pressure. Among suitable liquefied propellants are the lower alkanes containing up to five carbons, such as butane and propane; and preferably fluorinated or fluorochlorinated alkanes, such as are sold under the trademark "Freon." Mixtures of the above may also be employed.

In producing the aerosol, a container equipped with a suitable valve is filled with the appropriate propellant, containing the finely divided active ingredient and surfactant. The ingredients are thus maintained at an elevated pressure until released by action of the valve.

The amount of active compound administered will of course, be dependent on the subject being treated, the severity of the affliction, the manner of administration and the judgment of the prescribing physician. However, an effective dosage is in the range of 0.01–10 mg/kg/day, preferably 5 mg/kg/day. For an average 70 kg human, this would amount to 70–700 mg per day, or preferably 350 mg/day. While specific ranges and preferred doses are set out above, certain of the instant compounds may be effective at levels below that stated or the stated preferred dose level may not be appropriate in all instances. In light of the fact dose ranges may vary with the compound, these stated dose ranges should be viewed as guidelines for the practice of this invention and not hard and fast ranges which, if not adhered, to will result in the invention being rendered inoperable.

Pharmaceutically acceptable salts are those salts which retain the biological activity of the parent base compound and which are physiologically acceptable, ie non-toxic, substances. Such salts are those derived from inorganic bases include sodium, potassium, lithium, ammonium, calcium, magnesium, ferrous, zinc, copper, manganous, aluminum, ferric, maganic salts and the like. Particularly preferred are the ammonium, potassium, sodium, calcium and magnesium salts. Exemplary salts derived from organic bases include salts of primary, secondary, and tertiary amines, substituted amines including naturally occurring substituted amines, cyclic amines and basic ion exchange resins, such as isopropylamine, trimethylamine, diethylamine, triethylamine, tripropylamine, ethanolamine, 2-dimethylaminoethanol, 2-diethylaminoethanol, tromethamine, dicyclohexylamine, lysine, arginine, histidine, caffeine, procaine, hydrabamine, choline, betaine, ethylenediamine, glucosamine, methylglucamine, theobromine, purines, piperazine, piperidine, N-ethylpiperidine, polyamine resins and the like. Particularly preferred organic non-toxic bases are isopropylamine, diethylamine, ethanolamine, tromethamine, dicyclohexylamine, choline and caffeine.

The preparation of a salt is conducted in water, alone or in combination with an inert, water-miscible organic solvent, at a temperature of from about 0° C. to about 100° C., preferably at room temperature. Typical inert, water-miscible organic solvents include methanol, ethanol, or dioxane. The molar ratio of compounds of Formula I to base used are chosen to provide the ratio desired for any particular salt.

BACKGROUND MATERIALS

The compounds of this invention can be broken down into three subclasses comprising olefins, ethers and thioethers and exemplified by Formulas I(A), I(B'), I(B'') and I(B''') and I(C'), I(C'') and I(C''') respectively.

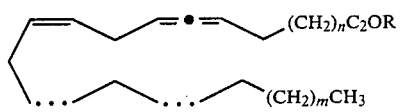

I(A)

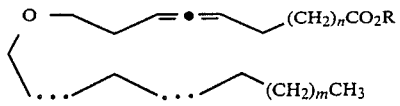

I(B')

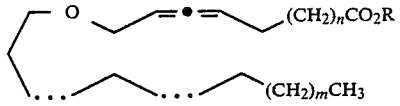

I(B'')

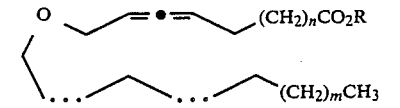

I(B''')

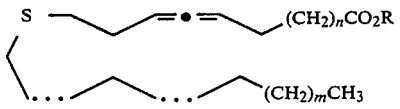

I(C')

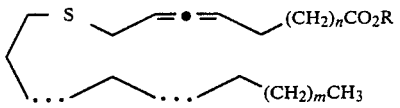

I(C'')

-continued

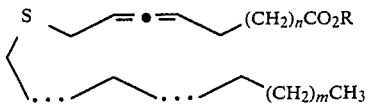

I(C''')

While each of these groups of compounds requires certain individual and distinct synthetic steps to prepare, all can be synthesized by the same general schematic system. That system comprises preparing the allene-containing portion of the molecule, graphically represented as the upper portion, up to the section represented by X and then reacting that moiety with the other, or lower, portion of the molecule to form the backbone of the molecule. When a hetero atom is present, it may be incorporated into the molecule either as part of the allene-containing moiety or the hetero atom can be the terminal functionality of the lower portion of the molecule. The acid functionality is present on the allene containing fragment or is introduced into the molecule once the backbone is formed and further converted to an ester or salt as desired.

Compounds according to Formula (I) wherein X is a double bond, i.e. those compounds represented by Formula I(A), are readily prepared by forming the allene-containing portion of the molecule as described in Reaction Scheme I, preparing the saturated or olefin portion of the molecule by the scheme in Reaction Scheme II, and piecing together these two fragments followed by introduction of the acid functionality as per Reaction Scheme III. All double bonds described in this invention are in the cis configuration unless designated otherwise.

Reaction Scheme I is as follows.

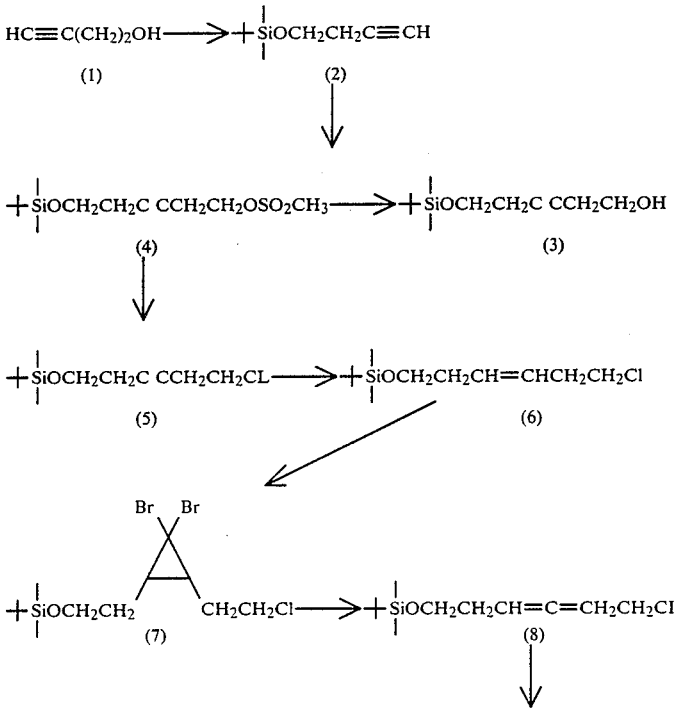

-continued

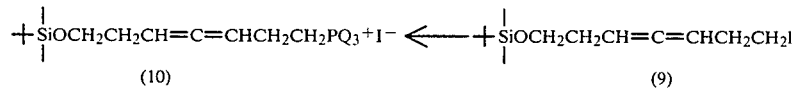

(10) (9)

The compound of Formula (1), 3-butyn-1-ol, is commercially available or is readily synthesized by known methods. The preparation of the silyl ether, e.g. Formula (2), from alcohol is a well known reaction. In this instance it may be carried out by mixing the alcohol and a twofold molar excess of imidazole in a dipolar aprotic solvent compatible with the imidazole, for example dimethyl formamide. A slight molar excess of t-butyldimethylsilyl chloride is added portionwise over 0.25–3 hours at about room temperature. This is the preferred temperature though it may range between 0°–50° C. The reaction is continued overnight for a period of 15–20 hours under an inert atmosphere such as nitrogen. Extraction and distillation provide the silyl ether of Formula (2).

Formation of the hexyn-1-ol silyl ether of Formula (3) is carried out by first preparing a suspension of lithium amide. This involves addition of lithium wire to ammonia containing a molar excess of ferric nitrate. To this is added a solution of the 3-butyn-1-ol silyl ether in an oxygen-containing dipolar aprotic solvent such a tetrahydrofuran in a volume approximately equal to one half the volume of ammonia. The addition of the silyl ether is over a short period, e.g. 5 to 20 minutes. When addition of the silyl ether is complete, the solution is refluxed for about 1 to 2 hours. A molar excess of ethylene oxide is then added in one portion and the reaction refluxed for about 10 to 15 hours. The ammonia is then allowed to evaporate, the resulting solution is diluted with water and extracted, washed and distilled to give the mono-t-butyldimethylsilyl ether of Formula (3).

The alcohol of Formula (3) is converted to the chloride by means of a organosulfonyl ester intermediate such as the mesylate depicted in Reaction Scheme I, Formula (4). Generally, the organosulfonyl intermediate may be prepared by dissolving the silyl ether of Formula (3) in a halogenated hydrocarbon solvent such as methylene chloride, which solution is then cooled to about −20° C. or thereabouts and treating this cooled solution with 1.5 molar equivalent of triethyl amine followed bya slight molar excess of organosulfonyl chloride. The reaction is usually complete in about 10 to 30 minutes at which time the reaction mixture is diluted with water, extracted with a appropriate organic solvent and, after being worked up, the solvent removed and the residue used directly in the preparation of the chloro compound without further purification.

Conversion of the mesylate to the chloro compound of Formula (5) is carried out by treating the mesylate with an amount of lithium chloride sufficient to effect the reaction, preferably a 10% molar excess, in a dipolar aprotic solvent such, for example, dimethylformamide. The reaction may be carried out at a temperature between 0°–50° C., preferably at ambient temperature overnight, at which time another portion of lithium chloride is added and the reaction continued for another period about half as long as the first. Dilution with water, extraction with an appropriate organic solvent and chromatographic purification affords the 6-chloro compound of Formula (5).

Reduction of Formula (5) to give the double bond containing compound of Formula (6) is done by a method which preferentailly gives the cis configuration. This is most readily done by catalytic hydrogenation using a heavy metal catalyst which preferentially gives the cis configuration. The preferred catalyst herein is the Lindlar catalyst. After dissolving the 6-chloro silyl ether in a simple alcohol such as ethanol, a few grams of catalyst are added and the solution is transfered to a hydrogenation flask and pressurized with hydrogen. When the uptake of one molar equivalent of hydrogen is complete, the catalyst is removed, the solvent evaporated and the resulting residue initially purified by, for example, silica gel chromatography. Further purification can be accomplished by distillation.

The allene group is introduced into the silyl ether compound of Formula (6) by means of a dibromocyclopropane intermediate. About a 2.5% volume of a 50% solution of an alkali metal base, such a potassium hydroxide, is added to bromoform prepraratory to adding this solution to the silyl ether. The silyl ether and a catalytic amount of tetra-n-butyl ammonium bromide are added to the bromoform/base mixture followed by slow addition, with cooling, the afore mentioned base at a 50% concentration and in an amount of about equal to or not less than 25% of the starting volume of the reaction mixture. Base is added over about 1 to 4 hours while maintaining the reaction flask temperature below about 60° C. This solution is then stirred at room temperature for about a day with portion-wise addition of the catalyst in an amount equal to about one half the originally added amount at each time point at about 2 hour intervals. The reaction mixture is diluted with a large quantity of halogenated organic solvent such as methylene chloride, filtered through celite, the organic layer filtered through silica gel and finally distilled at reduced pressure to give Formula (7), cis-1,1-dibromo-2-chloroethyl-3-hydroxyethylcyclopropane t-butyldimethylsilyl ether.

The allene group is achieved by dissolving the dibromocyclopropane compound, Formula (7), in an oxygen-containing dipolar aprotic solvent such as diethyl ether and cooling the mixture to about −65° C. A 10% molar excess of n-butyl lithium in a hydrocarbon solvent such as pentane or hexane is added slowly over a period of about 15 to 45 minutes with stirring. When addition of the n-butyl lithium is complete, the solution is stirred for an additional 20 to 60 minutes at the initial temperature and poured into cold water from which the diene is extracted and further purified by distillation, if desired.

The phosphonium compound of Formula (10) is prepared by converting the chloride of Formula (8) to the iodide with an alkali metal iodide and, without purifying the iodide, reacting that compound with triphenylphosphine. The iodide compound is prepared by refluxing the chloride in a weakly polar solvent such as acetone with an excess of, for example, sodium iodide for about 24 hours. After solvent extraction of the resultant iodo compound, it is treated with an excess of triphenylphosphine in acetonitrile or a similar polar solvent under reflux conditions for about 1 to 6 hours, preferably about 3 hours, to give the phosphonium iodide compound of Formula (10).

REACTION SCHEME II

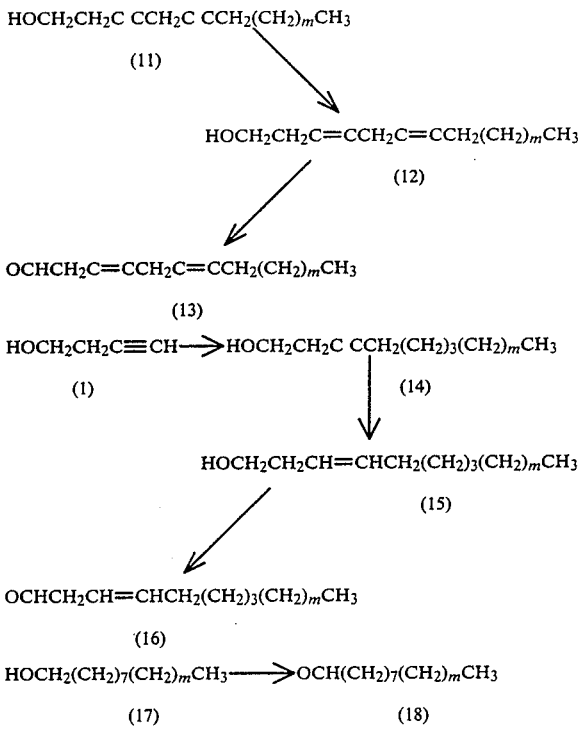

Compounds of Formula (11) are prepared in accordance with the publications by P. G. Philpott & J. C. Wickens, J. Chem. Soc., 2779 (1961) or T. Kajiwara, Ag. Bio. Chem., 41, 1481 (1977).

The 1-hydroxy-3Z,6Z-dienes of Formula (12) are prepared from the diynols of Formula (11) by hydrogenation using a heavy metal catalyst which preferentially gives the cis configuration. A Lindlar catalyst is the preferred catalyst. This reaction is carried out under the same conditions as described above for reducing the Formula (5) compound to that of Formula (6).

The dienol of Formula (12) may be oxidized to the aldehyde of Formula (13) by employing a mild oxidizing agent which preferentially yields the aldehyde. The preferred agent is the Collins reagent which employs chromium trioxide and pyridine in an organic solvent at mild temperatures. Usually the reaction is carried out by adding a catalytic amount of pyridine to an dipolar aprotic solvent such as, for example, methylene chloride, and adding the chromium trioxide in a 50% molar excess relative to the to be added alcohol. The alcohol is then added in a small amount of reaction solvent. The reaction is complete in a short time, about 5 to 20 minutes after which the reaction mixture is diluted with an organic solvent, filtered and extracted to recover the aldehyde, Formula (13).

The 1-hydroxy-3-yne compounds of Formula (14) in the above reaction scheme are prepared by adding 1-halo-octane to a solution of the dilithium salt of 3-butyn-1-ol in a solution of anhydrous ammonia. The reaction mixture is prepared by mixing a catalytic amount of ferric nitrate into a volume of anhydrous ammonia in equipment fitted with a condenser adequate to condense the ammonia. Lithium wire is then added in small portions until a twofold molar excess relative to the alkyne has been added. When the blue color is discharged, 3-butyn-1-ol is added in an ether such as tetrahydrofuran in a volume equal to about 20% of the anhydrous ammonia. The alcohol solution is added over 5 to 30 minutes after which the mixture is refluxed for about 30 to 90 minutes, preferably 60 minutes. A 20% molar excess of 1-halo-octane, preferably the bromo compound, in the solvent used to add the alcohol, is added to the refluxed mixture after which the resulting mixture is refluxed for 1–2 hours, preferably about 90 minutes. The entire reaction mixture is then poured onto ice from which the product is extracted and distilled.

Conversion of the 1-hydroxy-3-alkynes to the 3Z-alkenols and subsequently to the 3Z-alkenals is carried out as described above in the discussion on converting the compounds of Formula (11) to those of Formula (13).

1-Alkanals corresponding to those of Formula (18) is prepared by oxidizing the commercially available corresponding alcohol to the aldehyde using the same reagents and conditions noted in the several proceeding paragraphs.

Preparation of the Formula I (A) compounds is carried out as per Reaction Scheme III.

REACTION SCHEME III

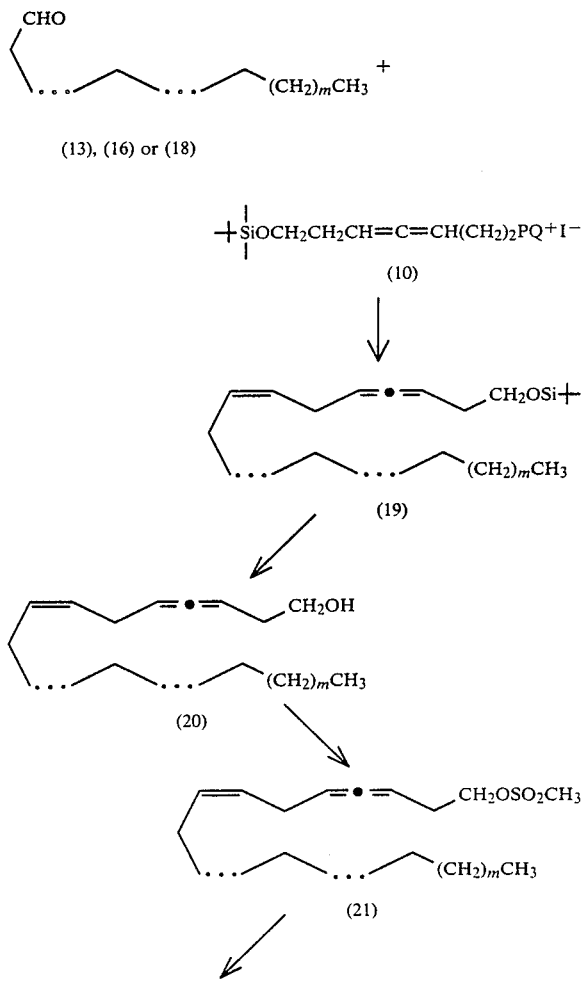

-continued

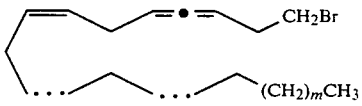

(22)

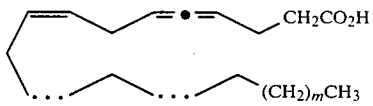

I(A)

Formula (19) compounds are realized by reacting one of the aldehydes from Reaction Scheme II with the phosphonium iodide silyl ether of Formula (10) from Reaction Scheme I. This is most readily carried out by dissolving the iodide in an oxygen-containing dipolar aprotic solvent, for example tetrahydrofuran, and cooling the solution to about −78° C. or thereabouts under an inert atmosphere such as argon. About one molar equivalent of n-butyl lithium is added and the reaction mixture stirred at the reduced temperature for about 0.5 to 1.5 hours, preferably 50 minutes. A mixture of hexamethylphosphorous triamide in a small amount of the reaction solvent is then added and the reaction mixture stirred very breifly after which the aldehyde is added in a small volume of the reaction solvent. The temperature of the reaction mixture is then allowed to rise to about 0 C. and diluted with an aqueous solution of inorganic base such as a bicarbonate. Organic solvent extraction gives the compounds of Formula (19).

The silyl ether is converted to the alcohol by hydrolysis with an tetraalkylammonium halide in an oxygen-containing dipolar aprotic solvent such as, for example, tetrahydrofuran at a temperature between 0°-50° C., but preferable room temperature. A 0.5 to 2N solution of the ammonium halide is used. The reaction is complete within about one hour at which time the reaction mixture is diluted with water and the product extracted with an organic solvent.

The resultant alcohol, Formula (20), is treated with an organic sulfonyl halide at a low temperature over a period of 10 to 60 minutes to effect formation of the compounds represented by the mesylate of Formula (21). While the mesylate is graphically represented herein, other appropriate organic sulfonates may be employed if so desired. The alcohol is dissolved in a suitable organic solvent such as a halogenated hydrocarbon, for example methylene chloride, and cooled to about −40° C. at which time the reaction solution is treated with a twofold excess of organic sulfonyl halide, preferably methane sulfonyl chloride. After stirring for 10 to 60 minutes, preferably 30 minutes, while maintaining the temperature between −40° to −30° C., the reaction mixture is diluted with water and the product extracted with the reaction solvent. Standard extraction workup procedures yield the sulfonate represented by Formula (21).

Introduction of the bromine in preparation for the Grignard type reaction which gives the acid is carried out by adding the sulfonate to a solution of lithium bromide in a polar solvent, such as acetone or the like, with reflux for about 30 to 90 minutes. The reaction mixture will contain a molar excess of lithium bromide. Preferably the reaction mixture is refluxed for about 45 minutes. Subsequent extraction and distillation procedures afford the bromo compounds of Formula (22).

The acidic function is introduced into the molecule by means of a Grignard reaction. In this instance, the Grignard reaction is initiated by briefly heating a mixture of magnesium turnings with ethyl bromide in a dry ether such as tetrahydrofuran. A solution of a bromo compound according to Formula (22) in the reaction solvent is added to the cooled mixture mentioned above and the reaction mixture refluxed for 10 to 40 minutes, preferably 20 minutes. After being refluxed, the reaction mixture is poured into a small amount of dry ice and an organic solvent. When this mixture comes to room temperature, it is treated with saturated aqueous ammonium chloride and extracted with the previously mentioned organic solvent to give an acid represented by Formula (23). The acid form may then be converted to the corresonding ester, a second ester or a salt by methods described elsewhere herein.

Compounds of Formula I where X is $OCH_2$, $CH_2O$ or O, the compounds of Formula I(B'), I(B'') and I(B'''), may be prepared by the series of reaction steps outlined in Reaction Schemes IV–VIII which follows.

REACTION SCHEME IV

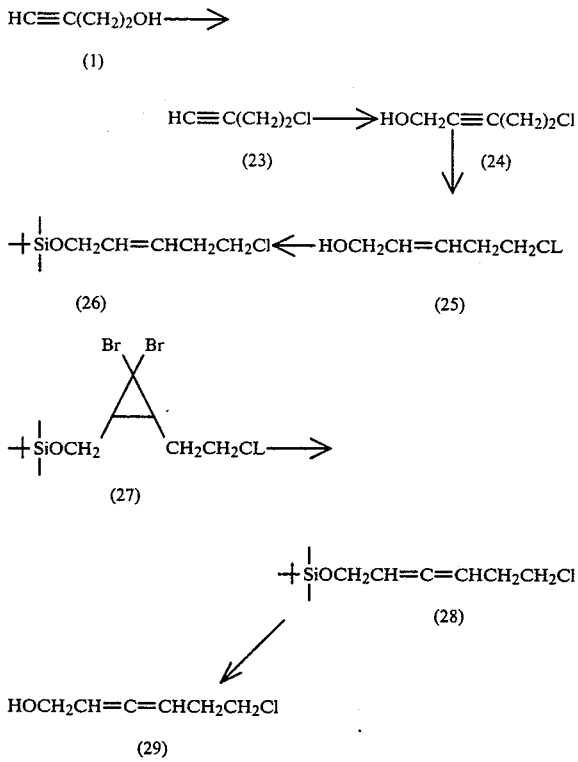

Formula (23) in Reaction Scheme IV is prepared from 3-butyn-1-ol by converting it to its chloro analogue which is then reacted with formaldehyde to add the hydroxymethyl group to the triple bond. The triple bond is then reduced to a double bond via hydrogenation using a catalyst which preferentially gives the cis configuration. The hydroxyl group is then converted to a silyl ether and the allene group introduced by converting the double bond to a dibromocyclopropane group which is subsequently rearranged by means of an alkyl lithium reagent to give the allene group. This compound is subsequently treated with a weak acid to effect hydrolysis of the silyl ether to give the alcohol of Formula (29).

The 3-butyn-1-ol, Formula (1), is converted to its chloro analogue by adding thionyl chloride to a neat solution of the alcohol to which a small volume of a pyridine, a catalyst, has been added. The thionyl chloride is added to the alcohol and catalyst at a reduced temperature (e.g. minus −20° to 10° C., but preferably at about 0° C.). After adding the thionyl chloride, the reaction temperature is allowed to rise to about room temperature for a period of about 15 to 60 minutes, preferably 30 minutes, after which time the reaction mixture is heated at between about 50°–100° C. for between about 1 to 4 hours, preferably 2.5 hours. This procedure, after appropriate isolation techniques, gives 1-chloro-3-butyne, the compound of Formula (23).

The 1-chloro-3-butyne is then converted to the 5-chloropent-2-yn-1-ol by dissolving the 1-chloro-3-butyne in an oxygen-containing dipolar aprotic solvent such as tetrahydrofuran and cooling the solution to a temperature of about −78° C. This cooled solution is then treated with n-butyl lithium over a period of about 10 to 60 minutes, preferably about 30 minutes. Paraformaldehyde, depolymerized by heating, is blown into the reaction mixture under a stream of inert gas such as nitrogen. After a few minutes, i.e. about 5 to 25 minutes but preferably about 10 minutes, the reaction mixture is diluted with water and extracted with an appropriate organic solvent. After workup, the residue is distilled to give 5-chloropent-2-yn-1-ol, Formula (24).

The alcohol is reduced to the corresponding cis-olefin, Formula (25), by catalytic hydrogenation using a stereoselective catalyst such as palladium partially poisoned with quinoline or lead acetate (Lindlar catalyst). The Lindlar catalyst is preferred. The reaction is carried out in a simple alcohol such as ethanol at about one atmosphere of pressure until one stoichiometric equivalent of hydrogen is absorbed. The resulting product is purified by distillation.

The silyl ether of Formula (26) is prepared by dissolving the alcohol of Formula (25) in a dipolar aprotic solvent such as dimethylformamide and treating the solution with a slight molar excess of imidazole and a 10% molar excess of t-butyldimethylsilyl chloride. About 0.5 to 3 hours at a temperature of about 0°–50° C. will effect the reaction. Preferably the reaction will be carried out at room temperature for about 1 hour. Extraction and subsequent distillation provide the silyl ether of Formula (26).

An allene group is introduced into the silyl ether compound of Formula (26) by means of a dibromocyclopropane intermediate. About a 2.5% volume of a 50% solution of an alkali metal base such a potassium hydroxide is added to bromoform prepraratory to adding this solution to the silyl ether. The silyl ether and a catalytic amount of tetra-n-butyl ammonium bromide are added to the bromoform/base mixture followed by slow addition, with cooling, the afore mentioned base at a 50% concentration and in an amount of about equal to or not less than 25% of the starting volume of the reaction mixture. Base is added over about 1 to 4 hours while maintaining the reaction flask temperature below about 60° C. This solution is then stirred at room temperature for about a day with portion-wise addition of the catalyst, in an amount equal to about one half the originally added, amount at each time point, at about 2 hour intervals. The reaction mixture is diluted with a large quantity of halogenated organic solvent such as methylene chloride, filtered through Celite, the organic layer filtered through silica gel and finally distilled at reduced pressure to give the Formula (27) cis-1,1-dibromo-2-chloroethyl-3-hydroxyethylcyclopropane t-butyldimethylsilyl ether.

The allene group is achieved by dissolving the dibromocyclopropane compound, Formula (28), in an oxygen-containing dipolar aprotic solvent such as diethyl ether and cooling the mixture to about −65° C. A 10% molar excess of n-butyl lithium in an alkene solvent such as pentane or hexane is added slowly over a period of about 15 to 45 minutes with stirring. When addition of the n-butyl lithium is complete, the solution is stirred for an additional 20 to 60 minutes at the initial temperature and poured into cold water from which the diene is extracted and further purified by distillation.

Hydrolysis of the silyl ether is carried out by treating the ether with a concentrated solution of a short-chain organic acid such as acetic acid, a method well known in the art. The ether is dissolved in the acid, preferably concentrated acetic acid, and a volume of about 10% water added. This solution is stirred at room temperature or thereabouts for 1 to 6 hours, preferably 3 hours. Subsequent extraction procedures and reduced pressure distillation affords the compound of Formula (29).

The following reaction scheme illustrates formation of an alcohol from the silyl ether.

REACTION SCHEME V

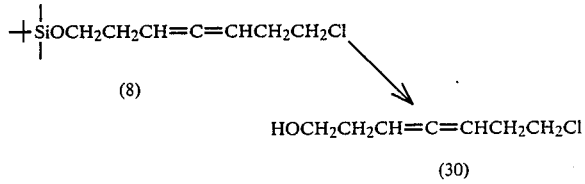

Formula (8) in Reaction Scheme IV is prepared as per the procedures set forth following Reaction Scheme I herein above.

Hydrolysis of the silyl ether to give the alcohol is carried out via an acid such as an organic acid like acetic acid. The t-butyldimethyl silyl ether is dissolved in concentrated acid to which added about 10% water. This mixture is stirred at a temperature between 0°–50° C. for 1–6 hours, preferably at room temperature for 3 hours. The reaction mixture is then diluted with water and extracted with an appropriate organic solvent. Subsequent distillation affords the dienol of Formula (30).

Preparation of ω-chloro,α-silyl ether compounds containing three methylene groups between the allene and the chloro moiety is outlined in the following reaction scheme.

REACTION SCHEME VI

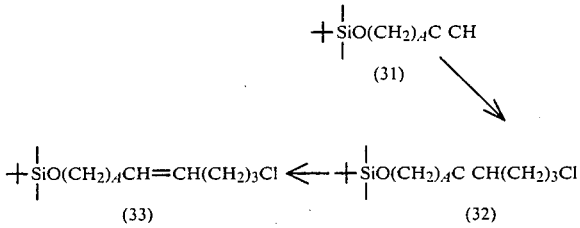

-continued

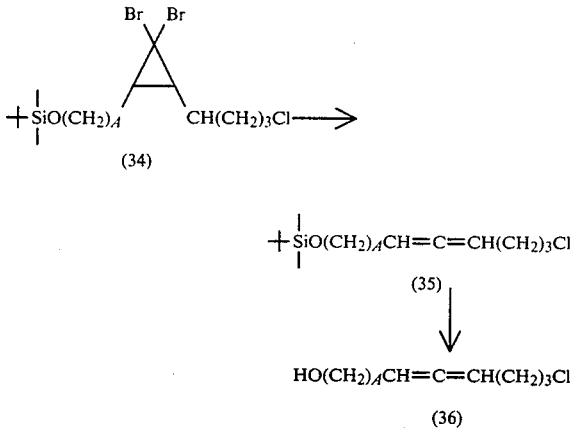

In this reactin scheme, A is the integer 1 or 2.

The t-butyldimethyl silyl ether starting materials of Formula (31) are prepared in the same manner as described for Formula (2) above, except that the propynol analog is substituted for the butynol compound when making the compound where A is 1.

These silyl ethers are converted to the alpha-hydroxy omega-chloro compound of Formula (32) by treating the silyl ether with 1,3-chlorobromopropane. The reaction is accomplished by adding lithium wire to ammonia which contains a catalytic amount of ferric nitrate. A solution of silyl ether is then added in an oxygen-containing dipolar aprotic solvent such as tetrahydrofuran in a volume approximately equal to one half the volume of ammonia. The silyl ether solution is added over a short period, e.g. 5 to 20 minutes. After addition of the ether, the solution is refluxed for about 1 to 2 hours. A molar excess of 1,3-chlorobromopropane is then added in one portion and the mixture refluxed for 1 to 3 hours. The ammonia is then allowed to evaporate, the residual solution diluted with water and extracted, the extract washed, evaporated and the residue distilled to give the compounds of Formula (33).

Reduction of the ω-chloroalkynol to the alkenol and its conversion to the allene-containing compound is carried out using the same reagents, conditions and techniques as described following Reaction Scheme I for converting Formula (6) to Formula (8).

Hydrolysis of the silyl ethers to the alcohols is carried out as per the process given in Reaction Scheme V.

REACTION SCHEME VII

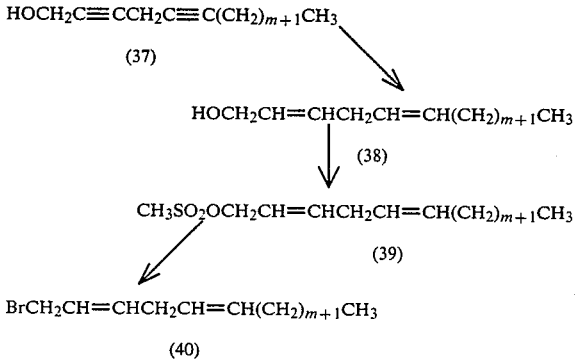

-continued

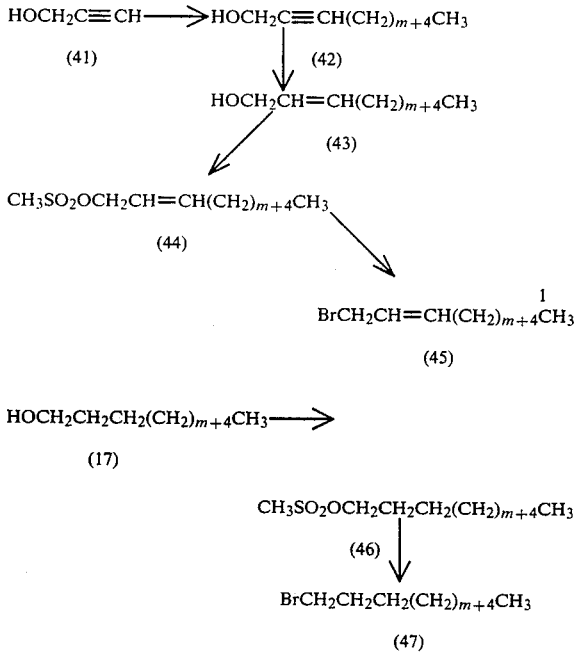

The 2Z,5Z-dienols of Formula (38) are prepared by reductive hydrogenation of the diyne compounds represented by Formula (37). The 2,5-diyn-1-ol compounds can be prepared by the method disclosed by J. M. Osband. *J.Chem.Soc.*, p 2779 (1961). A method for reducing triple-bond containing compounds to selectively give the cis configuration is discussed above under Reaction Scheme II, which set of conditions and reagents is equally applicable here. Preparation of the organic sulfonates and their conversion to the 1-bromo compounds of Formula (40) employs the same reagents and conditions described earlier with regard to Formulas (21) and (22) in Reaction Scheme III.

Formula (42) compounds are prepared as per the reaction conditions, reagents, etc. set out following Reaction Scheme II for converting 3-butyn-1-ol to the alcohols of Formula (14) except in this instance Formula (42) is substituted for 3-butyn-1-ol. Reduction of the 1-hydroxy-2-yn compounds, conversion of the alcohols (Formula (43)) to the sulfonates and thence to the bromide (Formula (45)) is achieved as noted in the previous paragraph.

The alcohols of Formula (17) are converted to the 1-bromo compounds of Formula (47) in the same manner described in the preceeding paragraph for converting alken-1-ols to their bromo analogues.

The following reaction scheme illustrates the preparation of unsaturated lower side chain fragments wherein the unsaturation is at position 3 and/or 5.

REACTION SCHEME VIII

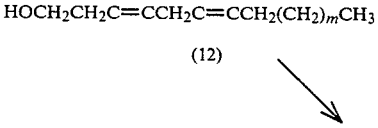

-continued $CH_3SO_2OCH_2CH_2CH{=}CHCH_2CH{=}CHCH_2(CH_2)_mCH_3$ (48)

$BrCH_2CH_2CH{=}CHCH_2CH{=}CHCH_2(CH_2)_mCH_3$ (49)

$HOCH_2CH_2CH{=}CHCH_2(CH_2)_3(CH_3)_mCH_3$ (15)

$CH_2SO_2OCH_2CH_2CH{=}CHCH_2(CH_2)_3(CH_2)_mCH_3$ (50)

$BrCH_2CH_2CH{=}CHCH_2(CH_2)_3(CH_2)_mCH_3$ (51)

Alcohols of Formulas (12) and (15) are prepared according procedure set forth following Reaction Scheme II. Conversion of these alcohols to the corresponding 1-bromo compounds is by means of an organic sulfonate intermediate exemplified by the mesylate in the above reaction scheme but not limited thereto by that drawing.

Reference is made to the discussion following Reaction Scheme II for the reagents and conditions needed to obtain the starting alcohols listed above.

The organic sulfonate compounds are prepared by using the same reagents and conditions set forth following Reaction Scheme VII herein above, as are the 1-bromo compounds illustrated in this Reaction Scheme.

By combining the proper allene-containing fragment with the appropriate alkane or alkene moiety, any of the compounds of Formula I wherein X is $OCH_2$, $CH_2O$ or O may be prepared using the same set of reagents and conditions. Reaction Scheme IX which follows graphically illustrates these preparations and is followed by applicable reaction reagents and conditions.

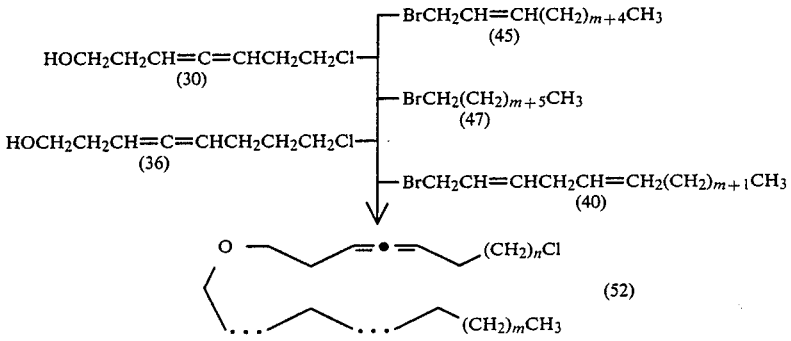

(52)

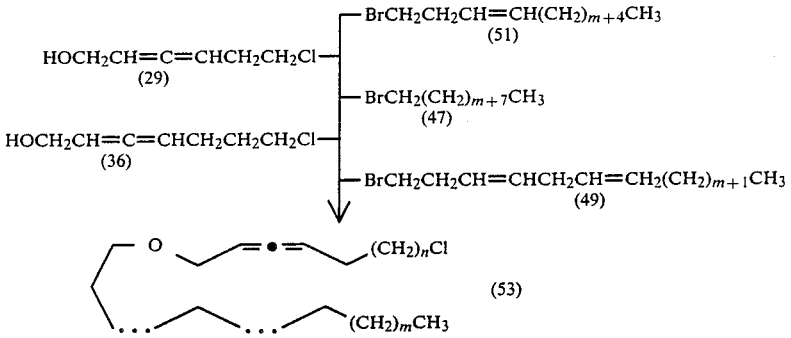

(53)

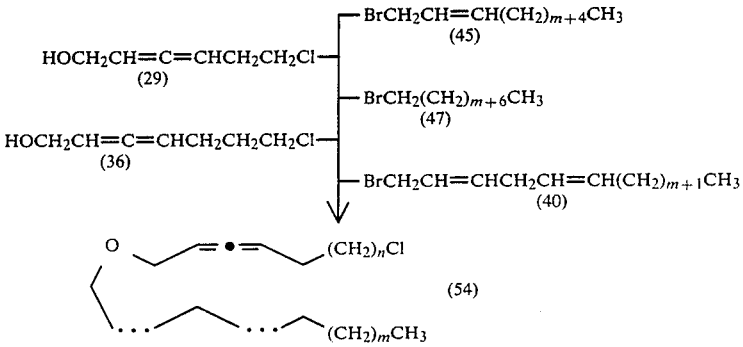

(54)

The several alpha-chloro compounds above are converted to their corresponding acid by the same reagents and set of reaction conditions, the synthetic steps being as follows wherein X is $OCH_2$, $CH_2O$ or O:

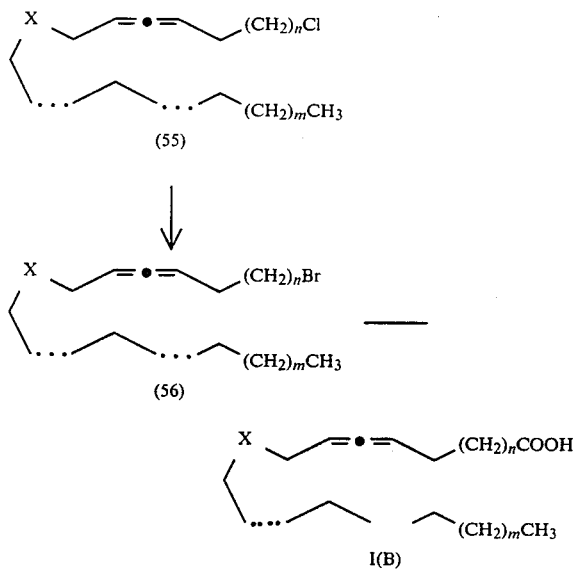

Formation of the 1-chloro compounds is carried out by means of a biphasic reaction which comprises mixing the two precursors in a nonpolar solvent such as, for example, toluene and adding an equal volume of aqueous base, an alkali metal base preferably, at a concentration of about 50%. This two phase system is stirred vigorously at between about 0°–50° C. for about 1 to 6 hours with periodic addition of a tetraalkyl ammonium bromide in catalytic amounts. Preferably, the reaction will be carried out at about room temperature for a period of about 3 hours. Water is then added and the resultant mixture extracted with an organic solvent. The product may be further purified by appropriate means.

The 1-chloro compounds are converted to the corresponding 1-bromo compounds by stirring and heating with 8 to 10 molar equivalents of lithium bromide in an appropriate polar solvent such as acetone. The reaction typically requires about 2–4 days at 30°–100° C., preferably 72 hours at 56° C. Water is then added to the reaction mixture and the 1-bromo compound extracted with an organic solvent. Products may be further purified by distillation or chromatography.

Conversion of the 1-bromo compound to the acid is by means of a Grignard reaction. In this instance the reagents and conditions needed to effect this conversion are the same as those as described earlier for the conversion of the 1-bromo compound (Formula (22)) in Reaction Scheme III to the acid, Formula I(A). Products may then be converted to esters, salts, etc. by appropriate means.

Sulfur-containing compounds of Formula I, i.e., Formulas I(C′), I(C″) and I(C‴) may be prepared by the steps graphically outlined in Reaction Schemes X-XIII.

REACTION SCHEME X

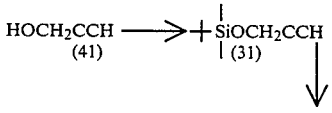

-continued

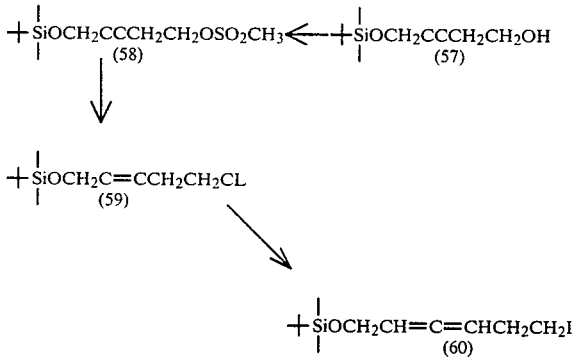

Preparation of compound (60) is carried out by starting with 3-propyn-1-ol and converting it to the iodide using the same reagents and conditions as described in Reaction Scheme I herein above for converting 4-butyn-1-ol to the iodide there, Formula (9).

The chloro compound of Formula (35) in Reaction Scheme VI is transformed to the iodide as per the following reaction scheme and the text following.

REACTION SCHEME XI

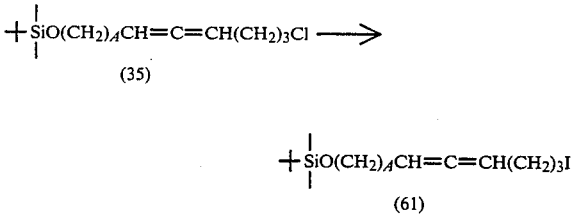

This conversion is achieved by employing the reagents and conditions described in Reaction Scheme I for converting Formula (8) to that of Formula (9).

The following reaction scheme illustrates conversion of iodide compounds such as Formula (61) and its analogs to omega-bromo esters which form the upper fragment of the sulfur-containing compounds of this invention.

REACTION SCHEME XII

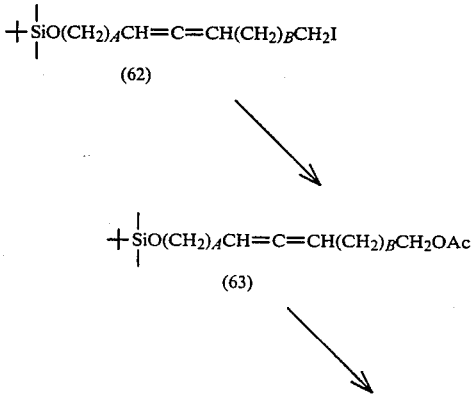

-continued

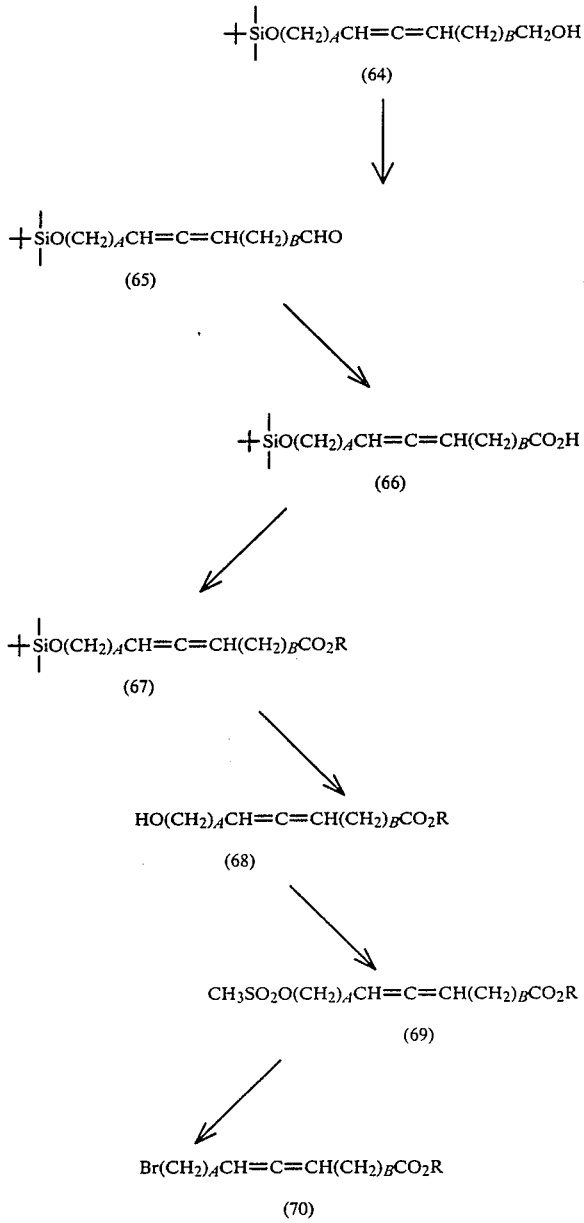

In the above Reaction Scheme, A is the integer 1 or 2 and B is the integer 2 or 3.

The iodide compounds are previously prepared as per Formula (60) in Reaction Scheme X and Formula (61) in Reaction Scheme XI. The iodide is converted to an acyl compound, for example the acetate, though any low molecular weight acyl compound would achieve the same end result, by dissolving the iodide in a small amount of a dipolar aprotic organic solvent and adding a tetraalkyl ammonium acylate wherein "alkyl" is 1 to 6 carbon atoms, preferably tetramethyl ammonium acetate, in a 50% molar excess. The addition is carried out over a period of up to 40 minutes, preferably about 20 minutes at a temperature between about 0°–50° C., preferably at ambient temperature. After a period ranging from about 30 minutes to 3 hours, generally 1 hour or thereabouts, the reaction mixture is diluted with water and the product extracted with an organic solvent. Following the workup, the residue may be further purified by chromatography or other appropriate method.

The acylate of the previous paragraph, Formula (63), is then hydrolyzed by means of a weak base to afford the alcohol. The reaction is carried out in a protic solvent such as a simple alcohol at a temperature between about −10° and 40° C. by the addition of an excess of weak base such as an alkali metal carbonate. Preferably the reaction will be carried out by dissolving the acylate in methanol and adding potassium carbonate to the solution at a temperature of about 0° C. This solution is then warmed to room temperature where the reaction is allowed to proceed for up to about 45 minutes, preferably 15 minutes. The solvent is then evaporated and the resulting residue treated with trialkyl amine and water. This solution is then extracted with an organic solvent which is washed and evaporated, leaving the alpha, omega-dihydroxy heptadiene silyl ether for use directly in the next step.

Preparation of the aldehyde is by means of a mild oxidizing reagent which will afford the aldehyde in preference to the acid. Herein it is preferred to use a chromium-based reagent such as the Collins reagent. The reaction is carried out by dissolving the alcohol in a polar halogenated hydrocarbon such as, for example, methylene chloride and adding this solution to a suspension of chromium trioxide pyridine complex (a 20% molar excess). After a period of no more than about 2 hours, preferably about 30 minutes, the reaction mixture is filtered through a chromatographic agent. Elution with an appropriate solvent affords the aldehyde.

The aldehyde is then oxidized to the acid by means of silver oxide. The silver oxide is prepared in situ by combining silver nitrate and an alkali metal base such potassium hydroxide in equivalent molar amounts in water. This suspension is then cooled to between about 0°–20° C., preferably about 15° C. and the aldehyde of Formula (65), in an amount of about 10% less mole-wise with regard to the silver oxide, is added in a simple alcohol such as, for example, methanol. The volume of the latter solution is about equal to that of the recipient solution. After a period of up to about 2 hours, usually about 30 minutes, the silver salts are filtered out and the filtrate cooled to between 0°–10° C., preferably 5° C. and the pH adjusted to about 2 with dilute mineral acid, e.g., hydrochloric acid. After saturating the solution with salt, the solution is extracted with an organic solvent.

The ester is conveniently prepared by treating the minimally purified acid with a slight molar excess of diazomethane at between 0°–35° C., preferably at room temperature. The solution is then treated with a 5% solution of a mineral acid such a hydrochloric acid to degrade any unreacted diazomethane, neutralized, saturated with a salt and extracted with an organic solvent. The resulting extract may be further purified by chromatographic or other separatory means. While only the methyl ester is described here, any other short chain ester of 2 to 5 carbons may be employed herein.

In preparation for preparing the 1-bromo compound of Formula (70), the silyl ether of the just described ester is hydrolyzed to the corresponding alcohol by means of an acid such as a short chain fatty acid. The process, reagents and conditions set out following Reaction Scheme IV for converting Formula (28) to Formula (29) is fully applicable in this instance.

The alcohol of the previous paragraph is reacted with an organic sulfonyl halide compound to form a sulfonyl ester for conversion to the bromo compound of Formula (70). This reaction is carried out by dissolving the alcohol in a mixture of triethyl amine and a halogenated hydrocarbon, cooling this solution to between about −40° and 0° C. and adding at least a 10% molar excess of organic sulfonyl halide. After about 60 minutes the reaction mixture is diluted with an equal volume of the reaction solvent and washed with water. Preferably the reaction will be carried out in methylene chloride with methane sulfonyl chloride at a temperature of −20° C. for a period of about 20 minutes. After a water, acid and base wash the solvent is evaporated to give the sulfonate ester.

This sulfonate product, Formula (69) is converted to the bromo compound by means of an alkali metal bromide in a weakly polar solvent such as a ketone at an initial temperature of between about −10° to 10° C. and final conditions of between about 0° to 45° C. A time of up to 3 hours is sufficient to effect the reaction. Preferably the sulfonate ester will be dissolved in, for example acetone, and cooled to about 0° C. To this cooled solution is added the alkali metal bromide, preferably lithium bromide, in the diluting solvent, over an extended period of about 20 minutes or so. The reaction mixture is then allowed to warm to room temperature and maintained there for about 1 hour. Water is then added to the reaction solution and the product extracted with an alternative organic solvent such as ether. After appropriate washes, the solvent is evaporated and the residue distilled to afford the bromo compound of Formula (70).

Preparation of the sulfur-containing lower side chains needed to make the compounds of Formula I(C′) and I(C‴) is outlined in the following reaction scheme.

REACTION SCHEME XIII

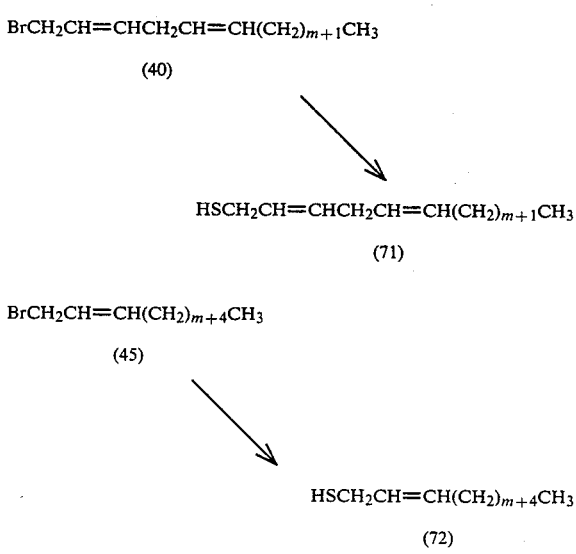

-continued

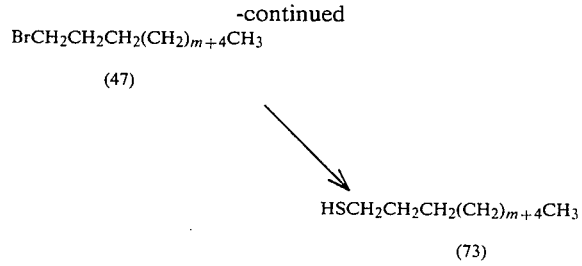

The 1-bromo compounds are converted to their mercapto analogs by dissolving the bromo starting material in a simple alcohol and adding a slight molar excess of N-alkyl thiopyrolidone, which solution is then refluxed for up to 4 hours. Preferably the bromo compound will be dissolved in ethanol and, after addition of N-methyl thiopyrolidone, refluxed for about 2 hours and cooled. To the cooled solution is added a half volume of water and a slightly larger volume of 1N aqueous base, an alkali metal base such as sodium hydroxide. After a period of between about 20 to 80 minutes, preferably 45 minutes, the reaction mixture is neutralized and the product extracted with an organic solvent. Washing and removal of the solvent gives a residue which can be further purified by chromatographic or other means.

Reaction Scheme XIV illustrates the preparation of the lower side chain fragments needed for making Formula I(C″) compounds.

REACTION SCHEME XIV

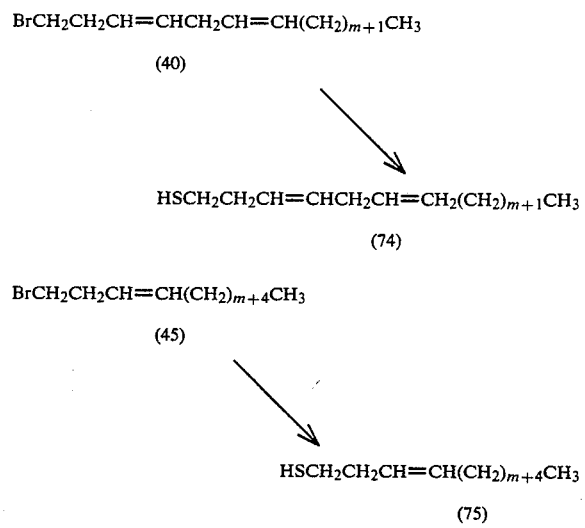

Conversion of the 1-bromo compounds of Formulas (40) and (45) to the corresponding mercaptans is achieved by using the same set of reagents and conditions described above in Reaction Scheme XIII for preparing the mercaptans thereof.

The allene-containing fragments and the saturated or unsaturated lower side chains from the several previous Reaction Schemes are pieced together to make the compounds of Formulas I(C′)–I(C‴) in the following schematically depicted manner.

REACTION SCHEME XV

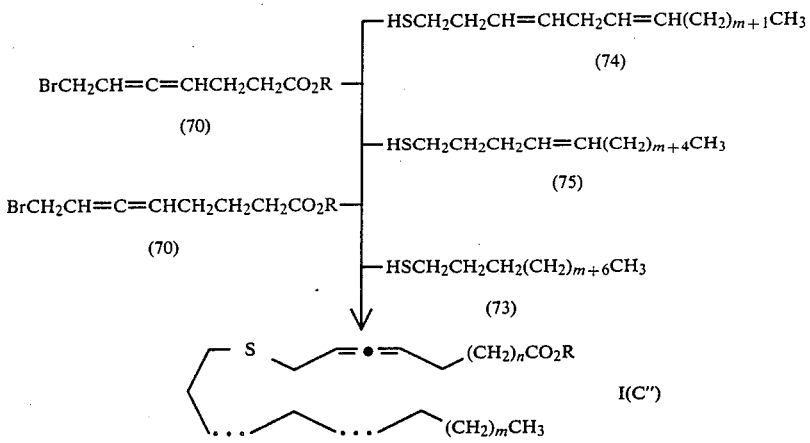

I(C")

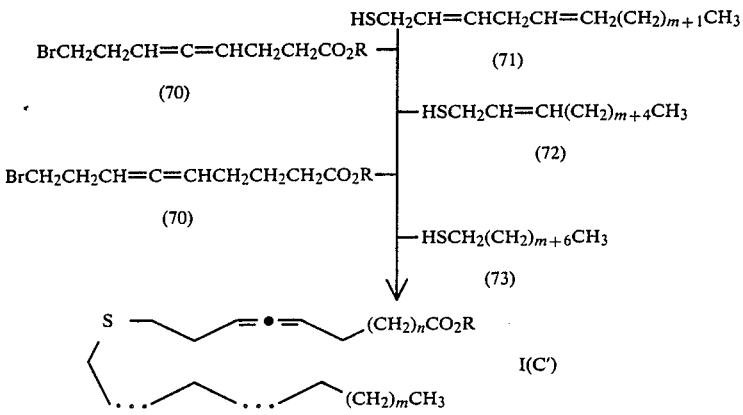

I(C')

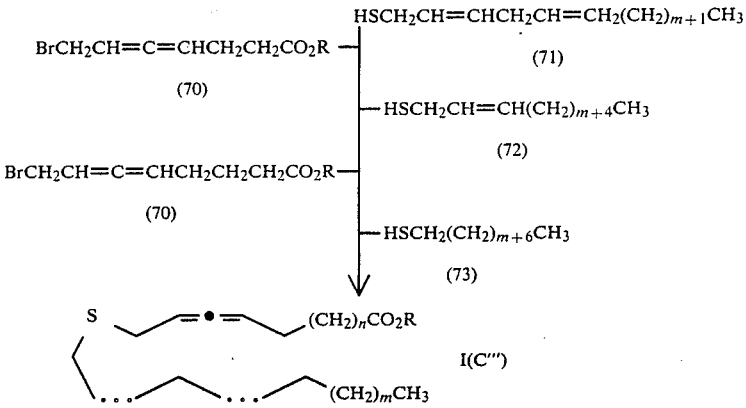

I(C''')

All Formula I(C')-(C''') products are prepared in the same manner using the identical set of reagents and conditions, but with the appropriate precursors as outlined above. A mixture of the allene-containing compound and a mercaptan, in a slight molar excess, along with a stoichometric amount of a trialkylamine are combined in a dipolar aprotic solvent such as an ether and stirred at a temperature between about 0°-45° C. for up to 2 hours. Preferably the reaction will be carried out in, for example tetrahydrofuran, at room temperature for about 1 hour. Preferred recovery procedures are to evaporate the solvent and separate the product by chromatographic means.

The ester may be converted to the acid by means of an alkali metal hydroxide such as lithium hydroxide. The reaction is carried out in a simple alcohol such as ethanol for a period of up to 20 hours, preferably 18, at room temperature or thereabout. Adjustment of the pH to about 4 and extraction and washing of the extract gives the acid.

The following Preparations and Examples are set forth to specifically illustrate the reactions described above. These Preparations and Examples are not intended to be limitive of the methods and techniques which may be used to prepare the compounds of this invention.

PREPARATION AND EXAMPLES

Preparation I 3-butyn-1-ol t-butyldimethylsilyl ether and analogue

A mixture of 21 g of 3-butyn-1-ol and 27 g of imidazole in 100 ml of dimethyl formamide was treated with 45 g of t-butyldimethylsilyl chloride in several portions over a one hour period. After stirring under nitrogen for 18 hours the reaction mixture was diluted with 500 ml of ice water. The resulting aqueous solution was extracted with 300 ml of ether and the ethereal solution washed with water and then brine. The ethereal solution was dried over potassium carbonate. Evaporation of the ether and distillation of the residue gave 47.6 g of 3-butyn-1-ol t-butyldimethylsilyl ether, bp 80°–83° C./25 mm.

Starting with 2-propyn-1-ol and using the preceeding process there may be prepared 2-propyn-1-ol t-butyldimethyl ether.

Preparation II 3-hexyn-1,6-diol t-butyldimethylsilyl ether and analogue

A suspension of lithium amide was prepared by slow addition of 0.42 g of lithium to 200 ml of ammonia containing 20 mg of ferric nitrate. A solution of 9.22 g of 3-butyn-1-ol t-butyldimethylsilyl ether in 100 ml of tetrahydrofuran was added over 15 minutes and the reaction mixture was allowed to reflux for 1.3 hours. 11 ml of ethylene oxide was added in one portion and the reaction refluxed for 12 hours and the ammonia allowed to evaporate. When the reaction temperature reached −5° C., ice-water was added and the product extracted with ether. After washing with brine and drying over potassium carbonate, removal of the solvent and distillation gave 3.98 g of the 1-t-butyldimethylsilyl ether of 3-hexyn-1,6-diol, bp 93°–95° C./1 mm.

Following this procedure, but substituting 2-propyn-1-ol t-butyldimethyl silyl ether for the 3-propyn-1-ol starting material there is prepared 2-pentyn-1,5-diol 1-t-butyldimethyl silyl ether.

Preparation III 3-hexyn-1,6-diol t-butyldimethylsilyl ether methyl sulfonate and analogue A solution of 3.9 g of 3-hexyn-1,6-diol mono-t-butyldimethylsilyl ether in 50 ml of methylene chloride was cooled to −20° C. and treated with 4.18 ml of triethyl amine and then 1.77 ml of methane sulfonyl chloride. After stirring 15 minutes at −20° C. the reaction mixture was diluted with water and extracted twice with 50 ml of methylene chloride. The organic layers were washed with brine, dried over sodium sulfate and evaported in vacuo to give the 3-hexyn-1,6-diol t-butyldimethylsilyl ether methyl sulfonate.

In a similar manner, there is prepared 2-pentyn-1,5-diol t-butyldimethylsilyl ether methyl sulfonate.

Preparation IV 6-chlorohex-3-yn-1-ol t-butyldimethylsilyl ether and analogue The residue from Preparation III (1.2 g) was added to a solution of 1.0 g of lithium chloride in 8 ml of dimethylformamide. The mixture was stirred 14 hours at room temperature and another 1 g portion of lithium chloride was then added. After stirring another 7 hours the reaction mixture was poured into water and extracted with 150 ml of ether. The ethereal solution was washed with brine, dried over potassium carbonate and evaporated in vacuo. The resulting oil was chromatographed on 40 g of silica gel, eluting with 10% ether/hexane, to give 0.743 g of 6-chlorohex-3-yn-1-ol t-butyldimethylsilyl ether, bp 80° C./0.5 mm.

The same procedure, but with substitution of the appropriate methane sulfonate, yields 5-chloropent-2-yn-1-ol t-butyldimethylsilyl ether.

Preparation V 6-chlorohex-3Z-en-1-ol t-butyldimethylsilyl ether and analogue 5.7 of 6-chlorohex-3-yn-1-ol t-butyldimethylsilyl ether in 50 ml of ethanol was hydrogenated under 1 atmosphere of hydrogen in the presence of 0.3 g of Lindlar catalyst until 370 ml of hydrogen had been absorbed. The catalyst was removed by filtration through celite and the ethanol evaporated in vacuo. The crude product was chromatographed on 200 g of silica gel, eluting with 1–4% ether/hexane. Distillation of the appropriate fractions gave 3.7 g of 6-chlorohex-3Z-en-1-ol t-butyldimethylsilyl ether, bp 80° C./0.5 mm.

Proceeding in the same manner there is prepared 5-chloropent-2Z-en-1-ol t-butyldimethylsilyl ether.

Preparation VI 1-chloro-3-butyne

To a mixture of 15.1 ml of 3-butyn-1-ol and 0.3 ml of pyridine at 0° C. was added 34 ml of thionyl chloride. The ice bath was removed and after 30 minutes at room temperature the reaction mixture heated at 70° C. for 2.5 hours. The mixture was then poured into ice water and extracted with 150 ml of methylene chloride. The organic solution was washed with sodium bicarbonate, dried over potassium carbonate and distilled giving 3.0 g of 1-chloro-3-butyne, bp 74°–80° C.

Preparation VII 5-chloropent-2-yn-1-ol

A solution of 6.45 g of 1-chloro-3-butyne in 40 ml of tetrahydrofuran was cooled to −78° C. and treated with 45.5 ml of 1.6N n-butyl lithium over a period of 30 minutes. 2.16 g of paraformaldehyde was depolymerized in a separate flask by heating and blown into the reaction mixture with a stream of nitrogen. After 10 minutes the reaction mixture was poured into water and extracted with ether. The organic solution was washed with brine and dried over potassium carbonate. Concentration and distillation gave 0.64 g of 5-chloropent-2-yn-1-ol, bp 73°–75° C./1 mm.

Preparation VIII 6-chlorohex-2Z-en-1-ol 5.7 g of 6-chlorohex-2-yn-1-ol in 50 ml of ethanol was hydrogenated under 1 atmosphere of hydrogen in the presence of 0.3 g of Lindlar catalyst until 370 ml of hydrogen had been absorbed. The catalyst was removed by filtration through celite and the ethanol evaporated in vacuo. The crude product was chromatographed on 200 g of silica gel, eluting with 1–4% ether/hexane. Distillation of the appropriate fractions gave 3.7 g of 6-chlorohex-2Z-en-1-ol, bp 93°–96°/1 mm.

Proceeding in the same manner, 5-chloropent-2Z-en-1-ol may be prepared.

Preparation IX 6-chlorohex-2Z-en-1-ol t-butyldimethylsilyl ether 98 g of 6-chlorohex-2Z-en-1-ol was dissolved in 250 ml of dimethylformamide and treated with 68 g of imidazole and 113 g of t-butyldimethylsilyl chloride. After stirring 1.5 hours at room temperature, the reaction mixture was poured into ice water and extracted twice with 300 ml of ether. The ethereal solution was washed with 5% hydrochloric acid, aqueous sodium bicarbonate and brine. After drying over potassium carbonate the solvent was evaporated and the residue distilled to give 168.1 g of 6-chlorohex-2Z-en-1-ol t-butyldimethylsilyl ether, bp 95°–100° C./0.4 mm.

Proceeding in a similar manner, 5-chloropent-2Z-en-1-ol t-butyldimethylsilyl ether is prepared.

Preparation X 7-chlorohept-3-yn-1-ol t-butyldimethylsilyl ether

A suspension of lithium amide is prepared by slow addition of 0.42 g of lithium to 200 ml of ammonia containing 20 mg of ferric nitrate. A solution of 9.22 g of 3-butyn-1-ol t-butyldimethylsilyl ether in 100 ml of tetrahydrofuran is added over 15 minutes and the reaction mixture was allowed to reflux for 1.3 hours. 11 ml of 1,3-chlorobromopropane is added in one portion and the reaction refluxed for 12 hours and the ammonia allowed to evaporate. When the reaction temperature reached −5° C., ice-water is added and the product extracted with ether. After washing with brine and drying over potassium carbonate, removal of the solvent and distillation gives the 1-t-butyldimethylsilyl ether of 7-chloropept-3-yn-1-ol t-butyldimethylsilyl ether.

Processing in the same manner, there is prepared 6-chlorohex-2-yn-1-ol t-butyldimethylsilyl ether.

Preparation XI 6-chlorohex-3Z-en-1-ol t-butyldimethylsilyl ether 5.2 g of 6-chlorohex-3-yn-1-ol t-butyldimethylsilyl ether in 50 ml of ethanol was hydrogenated under 1 atmosphere of hydrogen in the presence of 0.3 g of Lindlar catalyst wntil 370 ml of hydrogen had been absorbed. The catalyst was removed by filtration thru celite and the ethanol evaporated in vacuo. The crude product was chromatographed on 200 g of silica gel, eluting with 1 to 4% ether/hexane. Distillation of the appropriate fractions gave 3.7 g of 6-chlorohex-3Z-en-1-ol t-butyldimethylsilyl ether, bp 80°/0.5 mm.

Preparation XII cis-1,1-dibromo-substituted-cyclopropane t-butyldimethylsilyl ethers 200 ml of bromoform were treated with 5 ml of 50% aqueous potassium hydroxide. 168 g of 6-chlorohex-2Z-en-1-ol t-butyldimethylsilyl ether and 2 g of tetra-n-butyl ammonium bromide were added. A solution of 160 g potassium hydroxide in 160 ml of water was then added over 2 hours while cooling the reaction sufficiently to maintain the temperature below 60° C. The reaction was stirred at room temperature for 20 hours with 1.0 g portions of tetra-n-butyl ammonium chloride being added every 2 hours. One liter of methylene chloride was added and the entire mixture filtered through celite. The organic layer was separated, filtered through silica gel and distilled to give 146.3 g of cis-1,1-dibromo-2-(3-chloropropyl)-3-hydroxymethylcyclopropane t-butyldimethylsilyl ether, bp 100° C./0.015 mm.

Proceeding in the same manner, but substituting the appropriate olefin for 6-chlorohex-2Z-en-1-ol, there may be prepared the following compounds:

cis-1,1-dibromo-2-(2-chloroethyl)-3-(2-hydroxyethyl)-cyclopropane t-butyldimethylsilyl ether;

cis-1,1-dibromo-2-(2-chloroethyl-3-hydroxymethylcyclopropane t-butyldimethylsilyl ether; and cis-1,1-dibromo-2-(3-chloropropyl)-3-(2-hydroxyethyl)-cyclopropane t-butyldimethylsilyl ether.

Preparation XIII 7-chlorohepta-2,3-dien-1-ol t-butyldimethylsilyl ether and related allene compounds A solution of 146.3 g of cis-1,1-dibromo-2-(3-chloropropyl)-3-hydroxymethylcyclopropane t-butyldimethylsilyl ether in 500 ml of diethyl ether was cooled to −65° C. and 220 ml of 1.6N n-butyl lithium in hexane was added dropwise over 25 minutes. The reaction mixture was stirred at −65° C. for an additional 40 minutes and then poured into ice water. The organic layer was separated and washed with brine. After drying over potassium carbonate and evaporation of the solvent, distillation gave 71.8 g of 7-chlorohepta-2,3-dien-1-ol t-butyldimethylsilyl ether, bp 90°–97° C./0.3 mm.

In a similar manner, the cyclopropane compounds of Preparation VI are converted to the following compounds:

7-chlorohepta-3,4-dien-1-ol t-butyldimethylsilyl ether;

6-chlorohexa-2,3-dien-1-ol t-butyldimethylsilyl ether; and 8-chloroocta-3,4-dien-1-ol t-butyldimethylsilyl ether.

Preparation XIV 7-iodohepta-3,4-dien-1-ol t-butyldimethylsilyl ether

A mixture of 0.80 g of 7-chlorohepta-3,4-dien-1-ol t-butyldimethylsilyl ether, 1.0 g of sodium iodide and 5 ml of acetone were refluxed for 24 hours. The reaction mixture was cooled and diluted with 50 ml water. The product was extracted with 100 ml of ether and the ethereal solution washed with brine, dried over potassium carbonate and evaporated to give 7-iodohepta-4,5-dien-1-ol t-butyldimethylsilyl ether.

Proceeding in a similiar manner, but substituting the appropriate ωchloro compound from Preparation XIII there is/was prepared the following compounds:

7-iodohepta-3,4-dien-1-ol t-butyldimethylsilyl ether;

6-iodohexa-2,3-dien-1-ol t-butyldimethylsilyl ether; and 8-iodoocta-3,4-dien-1-ol t-butyldimethylsilyl ether.

Preparation XV 7-iodohepta-4,5-dien-1-ol t-butyldimethylsilyl ether phosphonium iodide The iodide from Preparation VIII was dissolved in 7 ml of acetonitrile and refluxed with 1.0 g of triphenylphosphine for 3 hours. At the end of this period the acetonitrile was removed under reduced pressure and the resulting oil diluted with 2 ml of ethyl acetate and 20 ml of ether. This caused crystallization of the phosphonium iodide which was collected and washed with ether, 1.538 g (mp 65°–72° C.).

Preparation XVI 7-chlorohepta-2,3-dien-1-ol

A solution of 2.6 g of 7-chlorohepta-2,3-dien-1-ol t-butyldimethyl silyl ether in 15 ml of acetic acid was treated with 2 ml of water and stirred at room temperature for 3 hours. The reaction mixture was poured into 100 ml of water and extracted three times with 100 ml of ether. The combined ethereal solutions were washed with aqueous sodium bicarbonate until carbon dioxide evolution ceased, washed with brine and dried over potassium carbonate. The solvent was removed in vacuo and the residue distilled to give 1.6 g of 7-chlorohepta-2,3-dien-1-ol (bp).

In the same manner, but substituting the appropriate silyl ether from Preparation XIII for 7-chlorohepta-2,3-dien-1-ol t-butyldimethylsilys ether there was prepared:
6-chlorohexa-2,3-dien-1-ol;
7-chlorohepta-3,4-dien-1-ol; and
8-chloroocta-3,4-dien-1-ol.

Preparation XVII 7-acetoxyhepta-2,3-dien-1-ol t-butyldimethylsilyl ether 7-iodohepta-2,3-dien-1-ol t-butyldimethylsilyl ether, in 50 ml dimethylformamide, was added to a slurry of 50 g of tetramethylammonium acetate at 20° C. over 20 minutes. The reaction mixture was stirred for 1 hour at 20° C. and then diluted with 500 ml of ice water. The product was extracted three times with 200 ml of ether and the ethereal extracts washed with water and brine, dried over potassium carbonate and concentrated. The product was chromatographed on silica gel, eluting with ether and hexane, to give 50.2 g of 7-acetoxyhepta-2,3-dien-1-ol t-butyldimethyl silyl ether. By the same procedure, 8-chloroocta-3,4-dien-1-ol t-butyldimethyl silyl ether may be converted to the 8-acetoxyhexa-2,3-dien-1-ol t-butyldimethyl silyl ether.

Preparation XVIII 7-hydroxyhepta-4,5-dien-1-al t-butyldimethylsilyl ether (a) A solution of 7-acetoxyhepta-2,3-dien-1-ol t-butyldimethyl silyl ether in 300 ml of methanol was treated with 18 g of potassium carbonate at 0° C. Then the reaction mixture was allowed to warm to room temperature and after 15 minutes the methanol was evaporated in vacuo and the mixture treated with 3 ml of triethylamine and 100 ml of water. The product was extracted three times with 200 ml of ether, washed with brine and dried over potassium carbonate. The ether was evaporated leaving the 1,7-dihydroxyhepta-2,3-diene 1-t-butyldimethylsilyl ether.

(b) This alcohol was dissolved in 30 ml of methylene chloride and added to a suspension of 64.4 g of chromium trioxide and 104 ml of pyridine in 800 ml of methylene chloride. After 30 minutes the reaction mixture was filtered through silica gel eluting with ether to give 15.02 g of 7-hydroxyhepta-4,5-dien-1-al t-butyldimethyl silyl ether.

This same process, starting with the ωchloro-αhydroxyoctadiene analogue provides 8-hydroxyocta-4,5-dien-1-al t-butyldimethyl ether.

Preparation XIX

Methyl 7-hydroxyhepta-4,5-dienoate t-butyldimethylsilyl ether

Silver oxide was prepared from 14 g of silver nitrate and 9 g potassium hydroxide in 120 ml of water. The suspension was cooled to 15° C. and 15 g of 7-hydroxyhepta-4,5-dien-1-al t-butyldimethyl silyl ether in 100 ml of methanol was added. After 30 minutes the silver salts were removed by filtration and the filtrate cooled to 5° C. and acified to pH 2 with dilute hydrochloric acid. The solution was saturated with sodium chloride and extracted three times with 300 ml of ether. This ethereal solution was treated with an excess of diazomethane. After washing with 5% hydrochloric acid, sodium bicarbonate and brine the ethereal solution was dried over potassium carbonate and concentrated in vacuo. The residue was chromatographed on silica gel, eluting with ether and hexane, to give 3.35 g of product which was distilled yielding 2.85 g of methyl 7-hydroxyhepta-4,5-dienoate t-butyldimethylsilyl ether, bp 105°-10° C./0.2 mm.

Methyl 8-hydroxyocta-4,5-dienoate t-butyldimethylsilyl ether is prepared by the same means but starting with the octa-4,5-diene compound in place of the hepta compound.

Preparation XX

Methyl 7-hydroxyhepta-4,5-dienoate

A solution of 2.8 g of methyl 7-hydroxyhepta-4,5-dienoate t-butyldimethyl silyl ether in 15 ml of acetic acid and 3 ml of water was stirred at room temperature for 3 hours. The reaction mixture was diluted with 100 ml of water and extracted three times with 150 ml of ether. The ethereal extracts were washed with aqueous sodium bicarbonate and brine. After drying over potassium carbonate the solvent was evaporated and the residue distilled to give 1.75 g of methyl 7-hydroxyhepta-4,5-dienoate, bp 80° C./0.03 mm.

With substitution of the 8-hydroxyocta analogue, this same process affords methyl 8-hydroxyocta-4,5-dienoate.

Preparation XXI

Methyl 7-bromohepta-4,5-dienoate

The dienoate from Preparation XX was dissolved in 20 ml of methylene chloride and cooled to −20° C. 3 ml of triethylamine and 1.30 ml of methane sulfonyl chloride were added. After 20 minutes the reaction mixture was diluted with 50 ml of methylene chloride and washed with water, diluted hydrochloric acid, sodium bicarbonate and then dried over potassium carbonate. The solvent was evaporated leaving the methane sulfonate ester of methyl 7-hydroxyhepta-4,5-dienoate.

This sulfonate was dissolved in 20 ml of acetone and cooled to 0° C. A solution of 4.0 g of lithium bromide in 30 ml of acetone was added over 20 minutes and the reaction mixture then allowed to warm to 20° C. for 1 hour. 100 ml of ice water was then added and the product extracted with ether. After washing with brine and drying over potassium carbonate the solvent was evaporated and the residue distilled giving 1.06 g of methyl 7-bromohepta-4,5-dienoate, bp 64°-65° C./0.01 mm. methyl 8-bromoocta-4,5-dienoate is made by the same process.

Preparation XXII

Preparation of 2 and 3 alkyn-1-ols is described herein.

To a mixture of 500 ml of anhydrous ammonia and 100 mg of ferric nitrate in a 2 liter three necked flask equiped with a mechanical stirrer and dry ice condenser was added 3.12 g of lithium wire in small portions.

When the blue color had discharged, 14.0 g of 3-butyn-1-ol in 100 ml of tetrahydrofuran was added over 15 minutes and the reaction mixture refluxed for 1 hour. A solution of 34.5 ml of 1-bromooctane in 200 ml of tetrahydrofuran was added and the reaction mixture was allowed to reflux for 90 minutes. At the end of this period the entire reaction mixture was poured onto 1 liter of ice and then saturated with salt. The resulting aqueous solution was extracted twice with 500 ml of ether and the combined ethereal solutions were washed with brine and dried over potassium carbonate. The ether was evaporated and the residue distilled to give 25.13 g of 3-dodecyn-1-ol, b.p. 87°-90°/0.5 mm.

Following the above procedure, but substituting the approriate 1-bromoalkane for 1-bromooctane and 2-propyn-1-ol for 3-butyn-1-ol, there is prepared the following compounds:

| | |
|---|---|
| 3-octyn-1-ol; | 2-octyn-1-ol; |
| 3-nonyn-1-ol; | 2-nonyn-1-ol; |
| 3-decyn-1-ol; | 2-decyn-1-ol; |
| 3-undecyn-1-ol; | 2-dodecyn-1-ol; |
| 3-tridecyn-1-ol; | 2-undecyn-1-ol; |
| 3-tetradecyn-1-ol; | 2-tridecyn-1-ol; and |
| 2-tetradecyn-1-ol. | |

Preparation XXIII

Reduction of alkynols and alkydiynols to the corresponding alkenes and dienols is illustrated by this Preparation.

A mixture of 24 g of 3-dodecyn-1-ol in 400 ml of ethanol and 1 g of Lindlar catalyst was hydrogenated under 1 atmosphere of hydrogen. The progress of the reaction was followed by gas chromatography until the acetylene was consumed. The catalyst was removed by filtration through celite and the ethanol evaporated. The resulting residue was distilled to give 23.09 g of 3Z-dodecen-1-ol, bp 83-86/0.3 mm.

Proceeding in the same manner but substituting the appropriate alkynol or alkdiynol for 3-dodecyn-1-ol, there may be prepared the following compounds:

| | |
|---|---|
| 3Z-octen-1-ol; | 3Z,6Z-octadien-1-ol; |
| 3Z-nonen-1-ol; | 3Z,6Z-nonadieno-1-ol; |
| 3Z-decen-1-ol; | 3Z,6Z-decadien-1-ol; |
| 3Z-undecen-1-ol; | 3Z,6Z-undecadien-1-ol; |
| 3Z-tridecen-1-ol; | 3Z,6Z-dodecadien-1-ol; |
| 3Z-tetradecen-1-ol; | 3Z,6Z-tridecadien-1-ol; |
| 3Z,6Z-tetradecadien-1-ol; | |
| 2Z-octen-1-ol; | 2Z,5Z-octadien-1-ol; |
| 2Z-nonen-1-ol; | 2Z,5Z-nonadien-1-ol; |
| 2Z,5Z-undecadien-1-ol, bp 73-78° C./1 mm; | |
| 2Z-undecen-1-ol; | 2Z,5Z-dodecadien-1-ol; |
| 2Z-tridecen-1-ol; | 2Z,5Z-dodecadien-1-ol; |
| 2Z-tetradecen-1-ol; | 2Z,5Z-tridecadien-1-ol; |
| 2Z-dodecadien-1-ol; | 2Z-decen-1-ol; and |
| 2Z,5Z-tetradecadien-1-ol. | |

Preparation XXIV

Reduction of mono and dialkynols from Preparation XXIII and pertinent primary alcohols to their corresponding aldehydes is carried out as follows.

A solution of 9.5 ml of pyridine in 150 ml of methylene chloride was treated in one portion with 6.0 g of chromium trioxide. The mixture was stirred for 15 minutes at room temperature and then 1.60 g of 3Z-dodecen-1-ol in 3 ml of methylene chloride was added. After 5 minutes the reaction mixture was diluted with 200 ml of ether and then filtered through celite. The filtrate was washed three times with 100 ml of 5% aqueous sodium hydroxide, then with ice-cold 5% hydrochloric acid, saturated sodium bicarbonate and finally with brine. After drying over sodium sulfate, the solvent was evaporated giving 1.5 g of 3Z-dodecen-1-al.

By this method, but substituting the appropriate alcohol for 3Z-dodecen-1-ol, there may be prepared the following aldehydes:

| | |
|---|---|
| 3Z-octen-1-al; | 1-octanal; |
| 3Z-nonen-1-al; | 1-nonanal; |
| 3Z-decen-1-al; | 1-decanal; |
| 3Z-undecen-1-al; | 1-undecanal; |
| 3Z-tridecen-1-al; | 1-dodecanal; |
| 3Z-tetradecen-1-al; | 1-tridecanal; |
| 3Z,6Z-octadien-1-al; | 1-tetradecanal; |
| 3Z,6Z-nonadien-1-al; | |
| 3Z,6Z-decadien-1-al; | |
| 3Z,6Z-dodecadien-1-al; | |
| 3Z,6Z-undecadien-1-al; | |
| 3Z,6Z-tridecadien-1-al; | |
| 3Z,6Z-tetradecadien-1-al; | |
| 2Z-octen-1-al; | |
| 2Z-nonen-1-al; | |
| 2Z-decen-1-al; | |
| 2Z-undecen-1-al; | |
| 2Z-docecen-1-al; | |
| 2Z-tridecen-1-al; | |
| 2Z-tetradecen-1-al; | |
| 2Z,5Z-octadien-1-al; | |
| 2Z,5Z-nonadien-1-al; | |
| 2Z,5Z-decadien-1-al; | |
| 2Z,5Z-dodecadien-1-al; | |
| 2Z,5Z-undecadien-1-al; | |
| 2Z,5Z-tridecadien-1-al; and | |
| 2Z,5Z-tetradecadien-1-al. | |

Preparation XXV

This Preparation illustrates the process for making 1-bromo-2Z,5Z-diene or 1-bromo-3Z,5Z-diene compounds from the diyn-1-ol precursor.

(a) 7.0 g of undeca-2Z,5Z-dien-1-ol in 54 ml of methylene chloride was treated at −25° C. with 8.7 ml of triethylamine and 3.69 ml of methane sulfonyl chloride. The reaction mixture was stirred for 30 minutes at −25° C. and then washed with water, 10% hydrochloric acid, saturated sodium bicarbonate and brine. The resulting organic solution was dried over potassium carbonate, filtered and concentrated in vacuo to yield the methane sulfonate ester of undeca-2Z,5Z-dien-1-ol.

(b) This mesylate was then dissolved in 36 ml of acetone, cooled to 0° C. and treated with a solution of 4.3 g of lithium bromide in 36 ml of acetone over 15 minutes. The reaction mixture was then stirred at 0° C. for 40 minutes. The solvent was removed in vacuo and the residue diluted with 100 ml of water and ether. The ethereal solution was removed, washed with brine and dried over sodium sulfate. The solvent was evaporated and the residue distilled to give 6.80 g of 1-bromo-2Z,5Z-undecadiene, bp 65°-72° C/1 mm.

Proceeding in a similar manner but substituting the appropriate diyn-1-ol or yn-1-ol for undecadiyn-1-ol, there may be prepared the following compounds:

| | |
|---|---|
| 1-bromo-2Z,5Z-octadiene; | 1-bromo-2Z-octene; |
| 1-bromo-2Z,5Z-nonadiene; | 1-bromo-2Z-nonaene; |
| 1-bromo-2Z,5Z-decadiene; | 1-bromo-2Z-decene; |
| 1-bromo-2Z,5Z-dodecadiene; | 1-bromo-2Z-dodecene; |
| 1-bromo-2Z,5Z-tridecadiene; | 1-bromo-2Z-tridecene; |

-continued 1-bromo-2Z,5Z-tetradecadiene; 1-bromo-2Z-tetradecene;
1-bromooctadiene;
1-bromononadiene;
1-bromodecadiene;
1-bromoundecadiene;
1-bromododecadiene;
1-bromotridecadiene;
1-bromotetradecadiene;
1-bromo-3Z,6Z-octadiene; 1-bromo-3Z-octene;
1-bromo-3Z,6Z-nonadiene; 1-bromo-3Z-nonene;
1-bromo-3Z,6Z-undecadiene; 1-bromo-3Z-undecene;
1-bromo-3Z,6Z-decadiene; 1-bromo-3Z-decene;
1-bromo-3Z,6Z-undecadiene; 1-bromo-3Z-undecene;
1-bromo-3Z,6Z-dodecadiene; 1-bromo-3Z-dodecene;
1-bromo-3Z,6Z-tridecadiene; 1-bromo-3Z-tridecene;
1-bromo-3Z,6Z-tetradecadiene; and
1-bromo-3Z-tetradecene.

Preparation XXVIII

This Preparation illustrates a process by which 1-mercapto olefins may be made.

A solution of 3 g of 1-bromo-2Z,5Z-undecadiene in 26 ml of absolute ethanol was treated with 1.64 g of N-methylthiopyrolidone and the mixture refluxed for 2 hours. The reaction mixture was cooled and treated with 13 ml water and 20 ml of 1N sodium hydroxide. After 45 minutes the reaction mixture was neutralized with 10% hydrochloric acid and extracted twice with ether. The ethereal solution was washed with brine and dried over sodium sulfate. The solvent was evaporated and the residue chromatographed on silica gel, eluting with methylene chloride to give 1.75 g of 1-mercapto-2Z,5Z-undecadiene (mp).

Proceeding in a similar manner but substituting the appropriate 1-bromo olefin for 1-bromo-2Z,5Z-undecadiene there may be prepared, for example, the following compounds:

1-mercapto-3Z,6Z-octadiene;
1-mercapto-3Z,6Z-nonadiene;
1-mercapto-3Z,6Z-decadiene;
1-mercapto-3Z,6Z-dodecadiene;
1-mercapto-3Z,6Z-tridecadiene;
1-mercapto-3Z,6Z-tetradecadiene;
1-mercapto-2Z,5Z-octadiene;
1-mercapto-2Z,5Z-nonadiene;
1-mercapto-2Z,5Z-decadiene;
1-mercapto-2Z,5Z-dodecadiene;
1-mercapto-2Z,5Z-undecadiene;
1-mercapto-2Z,5Z-tridecadiene;
1-mercapto-2Z,5Z-tetradecadiene;
1-mercapto-3Z-octene; 1-mercaptooctene;
1-mercapto-3Z-nonene; 1-mercaptononene;
1-mercapto-3Z-decene; 1-mercaptodecene;
1-mercapto-3Z-dodecene; 1-mercaptododecene;
1-mercapto-3Z-undecene; 1-mercaptoundecene;
1-mercapto-3Z-tridecene; 1-mercaptotridecene;
1-mercapto-3Z-tetradecene; 1-mercaptotetradecene;
1-mercapto-2Z-octene;
1-mercapto-2Z-nonene;
1-mercapto-2Z-decene;
1-mercapto-2Z-dodecene;
1-mercapto-2Z-undecene;
1-mercapto-2Z-tridecene; and
1-mercapto-2Z-tetradecene.

EXAMPLE I

This Example describes the formation of the primary molecular structure of Formula IA by means of piecing together the allene-containing fragment with the lower saturated or unsaturated moiety.

A solution of 0.62 g of 7-triphenylphosphoniumhepta-3Z,4Z-dien-1-ol t-butyldimethylsilyl ether iodide in 15 ml of tetrahydrofuran was cooled to −78° C. under argon and treated with 0.73 ml of n-butyl lithium (1.5 molar) and the reaction mixture stirred at −78° C. for 50 minutes. A mixture of 1.2 ml of hexamethylphosphorous triamide and 3 ml of tetrahydrofuran was added and the reaction mixture stirred for another 3 minutes at −78° C. A solution of 0.22 ml of dodecyl aldehyde in 3 ml of tetrahydrofuran was then added and the reaction temperature allowed to rise to 5° C. over a 15 minute period. The reaction mixture was then diluted with aqueous sodium bicarbonate and extracted with 100 ml of ether. The ethereal extract was washed with water and brine and then dried over potassium carbonate. The ether was removed in vacuo to give 0.303 g of nonadeca-3,4,7Z-trien-1-ol t-butyldimethylsilyl ether.

Following the above procedure but substituting the appropriate mono or diolefin or alkane aldehyde of Preparation XIV for dodecyl aldehyde there may be prepared:

hexadeca-3,4,7Z,10Z-tetraen-1-ol-t-butyldimethylsilyl ether;
heptadeca-3,4,7Z,10Z-tetraen-1-ol-t-butyldimethylsilyl ether;
octadeca-3,4,7Z,10Z-tetraen-1-ol-t-butyldimethylsilyl ether;
nonadeca-3,4,7Z,10Z-tetraen-1-ol-t-butyldimethylsilyl ether;
eicosa-3,4,7Z,10Z-tetraen-1-ol-t-butyldimethylsilyl ether;
heneicosa-3,4,7Z,10Z-tetraen-1-ol-t-butyldimethylsilyl ether;
hexadeca-3,4,7Z,10Z,13Z-pentadien-1-ol-t-butyl-dimethyl ether;
heptadeca-3,4,7Z,10Z,13Z-pentadien-1-ol-t-butyl-dimethyl ether;
octadeca-3,4,7Z,10Z,13Z-pentadien-1-ol-t-butyl-dimethyl ether;
nonadeca-3,4,7Z,10Z,13Z-pentadien-1-ol-t-butyl-dimethyl ether;
eicosa-3,4,7Z,10Z,13Z-pentadien-1-ol-t-butyldimethyl ether;
heneicosa-3,4,7Z,10Z,13Z-pentadien-1-ol-t-butyl-dimethyl ether;
hexadeca-3,4,7Z-trien-1-ol t-butyl-dimethylsilyl ether;
heptadeca-3,4,7Z-trien-1-ol t-butyl-dimethylsilyl ether;
octadeca-3,4,7Z-trien-1-ol t-butyl-dimethylsilyl ether;
eicosa-3,4,7Z-trien-1-ol t-butyl-dimethylsilyl ether; and
heneicosa-3,4,7Z-trien-1-ol t-butyl-dimethylsilyl ether.

EXAMPLE II

This Example illustrates the preparation of 1-bromo compounds through the hydrolysis of the silyl ether, formation of the mesylate and conversion of that to the α-bromo compounds.

(a) A solution of 280 mg of nonadeca-3,4,7Z-trien-1-ol t-butyldimethylsilyl ether in 2 ml of tetrahydrofuran was treated at room temperature with 2 ml of 1N tetra-n-butylammonium fluoride in tetrahydrofuran. After 30 minutes the reaction mixture was diluted with 25 ml of water and extracted with ether. The ethereal solution was washed with brine, dried over potassium carbonate and concentrated to yield nonadeca-3,4,7Z-trien-1-ol.

(b) This alcohol was dissolved in 10 ml of methylene chloride, cooled to −40° C. and treated with 0.3 ml of triethylamine followed by 0.2 ml of methane sulfonyl chloride. After stirring for 30 minutes at −30° C., the reaction mixture was diluted with water and extracted with methylene chloride. The organic solution was washed with brine, dried over potassium carbonate and concentrated in vacuo to yield 168 mg of nonadeca-3,4,7Z-trien-1-ol methane sulfonate.

(c) The methane sulfonate was added to a solution of 1 g of lithium bromide in 10 ml of acetone and the reaction mixture refluxed for 45 minutes. After cooling to room temperature this mixture was poured into ice water and extracted with ether. The ethereal solution was washed with brine, dried over potassium carbonate and then evaporated to give an oil which upon distillation gave 145 mg of 1-bromononadeca-3,4,7Z-triene, bp 120° C./0.015 mm.

Proceeding in the same manner, but replacing nonadeca-3,4,7Z-triene-1-ol with the appropriate silyl ether from Example I, there may be prepared the following exemplary compounds:

1-bromohexadeca-3,4,7Z,10Z-tetraene;
1-bromoheptadeca-3,4,7Z,10Z-tetraene;
1-bromoeicosa-3,4,7Z,10Z-tetraene;
1-bromoheneicosa-3,4,7Z,10Z-tetraene;
1-bromohexadeca-3,4,7Z,10Z,13Z-pentaene;
1-bromoeicosa-3,4,7Z,10Z,13Z-pentaene;
1-bromoheneicosa-3,4,7Z,10Z,13Z-pentaene;
1-bromoheptadeca-3,4,7Z-triene;
1-bromooctadeca-3,4,7Z-triene; and
1-bromoeicosa-3,4,7Z-triene.

EXAMPLE III

A mixture of 5.1 g of 1-bromo-2Z,5Z-undecadiene, 2.7 g of 7-chlorohepta-3,4-dien-1-ol 20 ml of toluene, 20 ml of 50% aqueous potassium hydroxide and 0.5 g of tetra n-butyl ammonium bromide were vigorously stirred at room temperature for 3 hours with 0.2 g portions of tetra n-butyl ammonium bromide being added periodically. At the end of this period, 100 ml of water was added and the mixture extracted with 20 ml of ether. The organic layer was washed with brine, dried over potassium carbonate and concentrated. This residue was chromatographed on silica gel, eluting with hexane and ether, to give 1-chloro-8-oxanonadeca-3,4,10Z,13Z-tetraene.

By substituting the appropriate 1-bromo, olefin or alkane from Preparation XXIX for 1-bromo-2Z,5Z-undecadiene or substituting 6-chlorohexa-2,3-dien-1-ol 7-chlorohepta-3,4-dien-1-ol there may be prepared the following compounds:

1-chloro-8-oxaheptadeca-3,4-diene;
1-chloro-8-oxaoctadeca-3,4-diene;
1-chloro-8-oxanonadeca-3,4-diene;
1-chloro-8-oxaeicosa-3,4-diene;
1-chloro-8-oxaheneicosa-3,4-diene;
1-chloro-8-oxadoeicosa-3,4-diene;
1-chloro-8-oxaheptadeca-3,4,10Z-triene;
1-chloro-8-oxaoctadeca-3,4,10Z-triene;
1-chloro-8-oxanonadeca-3,4,10Z-triene;
1-chloro-8-oxaeicosa-3,4,10Z-triene;
1-chloro-8-oxaheneicosa-3,4,10Z-triene;
1-chloro-8-oxadoeicosa-3,4,10Z-triene;
1-chloro-8-oxaheptadeca-3,4,10Z,13-tetraene;
1-chloro-8-oxaoctadeca-3,4,10Z,13-tetraene;
1-chloro-8-oxanonadeca-3,4,10Z,13-tetraene;
1-chloro-8-oxaeicosa-3,4,10Z,13-tetraene;
1-chloro-8-oxaheneicosa-3,4,10Z,13Z-tetraene;
1-chloro-8-oxadoeicosa-3,4,10Z,13Z-tetraene;
1-chloro-7-oxaheptadeca-3,4-diene;
1-chloro-7-oxaoctadeca-3,4-diene;
1-chloro-7-oxanonadeca-3,4-diene;
1-chloro-7-oxaeicosa-3,4-diene;
1-chloro-7-oxaheneicosa-3,4-diene;
1-chloro-7-oxadoeicosa-3,4-diene;
1-chloro-7-oxapentadeca-3,4,10Z-triene;
1-chloro-7-oxahexadeca-3,4,10Z-triene;
1-chloro-7-oxaheptadeca-3,4,10Z-triene;
1-chloro-7-oxaoctadeca-3,4,10Z-triene;
1-chloro-7-oxanonadeca-3,4,10Z-triene;
1-chloro-7-oxaeicosa-3,4,10Z-triene;
1-chloro-7-oxaheneicosa-3,4,10Z-triene;
1-chloro-7-oxadoeicosa-3,4,10Z-triene;
1-chloro-7-oxaheptadeca-3,4,10Z,13Z-tetraene;
1-chloro-7-oxaoctadeca-3,4,10Z,13Z-tetraene;
1-chloro-7-oxanonadeca-3,4,10Z,13Z-tetraene;
1-chloro-7-oxaeicosa-3,4,10Z,13Z-tetraene
1-chloro-7-oxaheneicosa-3,4,10Z,13Z-tetraene;
1-chloro-7-oxadoeicosa-3,4,10Z,13Z-tetraene;
1-chloro-9-oxaoctadeca-4,5-diene;
1-chloro-9-oxanonadeca-4,5-diene;
1-chloro-9-oxaeicosa-4,5-diene;
1-chloro-9-oxaheneicosa-4,5-diene;
1-chloro-9-oxadoeicosa-4,5-diene;
1-chloro-9-oxatrieicosa-4,5-diene;
1-chloro-9-oxaoctadeca-4,5,11Z-triene;
1-chloro-9-oxanonadeca-4,5,11Z-triene;
1-chloro-9-oxaeicosa-4,5,11Z-triene;
1-chloro-9-oxaheneicosa-4,5,11Z-triene;
1-chloro-9-oxadoeicosa-4,5,11Z-triene;
1-chloro-9-oxatrieicosa-4,5,11Z-triene;
1-chloro-9-oxaoctadeca-4,5,11Z,14Z-tetraene;
1-chloro-9-oxanonadeca-4,5,11Z,14Z-tetraene;
1-chloro-9-oxaeicosa-4,5,11Z,14Z-tetraene;
1-chloro-9-oxaheneicosa-4,5,11Z,14Z-tetraene;
1-chloro-9-oxadoeicosa-4,5,11Z,14Z-tetraene;
1-chloro-9-oxatrieicosa-4,5,11Z,14Z-tetraene;
1-chloro-8-oxaoctadeca-4,5-diene;
1-chloro-8-oxanonadeca-4,5-diene;
1-chloro-8-oxaeicosa-4,5-diene;
1-chloro-8-oxaheneicosa-4,5-diene;
1-chloro-8-oxadoeicosa-4,5-diene;
1-chloro-8-oxatrieicosa-4,5-diene;
1-chloro-8-oxaoctadeca-4,5,11Z-triene;
1-chloro-8-oxanonadeca-4,5,11Z-triene;
1-chloro-8-oxaeicosa-4,5,11Z-triene;
1-chloro-8-oxaheneicosa-4,5,11Z-triene;
1-chloro-8-oxadoeicosa-4,5,11Z-triene;
1-chloro-8-oxatrieicosa-4,5,11Z-triene;
1-chloro-8-oxaoctadeca-4,5,11Z,14Z-tetraene;
1-chloro-8-oxanonadeca-4,5,11Z,14Z-tetraene;
1-chloro-8-oxaeicosa-4,5,11Z,14Z-tetraene;
1-chloro-8-oxaheneicosa-4,5,11Z,14Z-tetraene;
1-chloro-8-oxadoeicosa-4,5,11Z,14Z-tetraene; and
1-chloro-8-oxatrieicosa-4,5,11Z,14Z-tetraene.

EXAMPLE IV

A mixture of 0.46 g of 1-chloro-8-oxanonadeca-3,4,10Z,13Z-tetraene and 3 g of lithium bromide in 10 ml of acetone was refluxed for 14 hours. The reaction mixture was cooled, poured into ice water and extracted twice with 50 ml of ether. The ethereal solution was washed with brine, dried over potassium carbonate and concentrated in vacuo to give 1-bromo-8-oxanonadeca-3,4,10Z,13Z-tetraene. Proceeding in the same manner, all 1-chloro compounds of Example III may be converted to the corresponding 1-bromo compound.

EXAMPLE V

Preparation of Formula IA, I(B'), I(B'') and I(B''') acids via the Grignard reaction is described herein.

A mixture of 200 mg of magnesium turnings, 5 ml of tetrahydrofuran and 0.37 ml of ethyl bromide was heated briefly to initiate a Grignard reaction and then allowed to cool. A solution of 130 mg of 1-bromononadeca-3,4,7Z-triene in 2 ml of tetrahydrofuran was added and the entire mixture was refluxed for 20 minutes. After cooling to room temperature, the reaction mixture was poured onto 50 g of dry ice and 100 ml of ether. This mixture was allowed to warm to room temperature and then treated with 50 ml of saturated aqueous ammonium chloride. Extraction with ether, washing with brine and drying over sodium sulfate followed by removal of the solvents gave a residue which was chromatographed on 20 g of silica gel (eluting with ether/hexane/acetic acid mixtures) to give 24 mg of 4,5,8Z-eicosatrienoic acid having the following NMR spectrum. The spectrum was run at 300 MHz in deutochloroform solution with TMS as the internal standard:

δ0.88 (t, 3H, J=7 Hz, $C_{20}$), 1.2–1.4 (m, 18H, $C_{11}$–$C_{19}$), 2.02 (dt, 2H, J=6.6 Hz, $C_{10}$), 2.31 (m, 2H, $C_3$), 2.47 (t, 2H, J=7.3 Hz, $C_2$), 2.72 (dt, 2H, J=3.4, 6.1 Hz, $C_7$), 5.10–5.23 (m, 2H, $C_4$ & $C_6$), and 3.33–3.47 (m, 2H, $C_8$ & $C_9$).

Following this procedure, but substituting the appropriate α-bromo compound from Examples II and IV for 1-bromononadeca-3,4,7Z-triene, there is prepared the following acids:

4,5,8Z,11Z-eicosatetraenoic acid, NMR spectrum; δ0.88 (t, 3H, J=7 Hz, $C_{20}$), 1.2–1.4 (m, 12H, $C_{14}$–$C_{19}$), 2.05 (dt, 2H, J=6 Hz, $C_{13}$), 2.32 (m, 2H, $C_3$), 2.47 (t, 2H, J=7 Hz, $C_2$), 2.78 (m, 4H, $C_9$ & $C_{10}$), 5.12–5.24 (m, 2H, $C_4$ & $C_6$) and 5.28–5.47 (m, 4H, $C_8C_9C_{11}$ & $C_{12}$);

4,5,8Z,11Z,14Z-eicosapentaenoic acid, NMR spectrum, δ0.89 (t, 3H, J=Hz, $C_{20}$), 2.2–2.4 (m, 6H, $C_{17}$–$C_{19}$), 2.05 (dt, 2H, J=6.8 Hz, $C_{16}$), 2.31 (m, 2H, $C_3$), 2.47 (t, 2H, J=6.9 Hz, $C_2$), 2.70–2.86 (m, 6H, $C_7C_{10}$ & $C_{13}$), 5.13–5.26 (m, 2H, $C_4$ & $C_6$) and 5.29–5.48 (m, 6H, $C_8C_9C_{11}C_{12}C_{13}$ & $C_{14}$).

4,5,8Z,11Z-heptadecatetraenoic acid;
4,5,8Z,11Z-octadecatetraenoic acid;
4,5,8Z,11Z-nonadecatetraenoic acid;
4,5,8Z,11Z-heneicosatetraenoic acid;
4,5,8Z,11Z-doeicosatetraenoic acid;
4,5,8Z,11Z-trieicosatetraenoic acid;
4,5,8Z,11Z,14Z-heptadecapentaenoic acid;
4,5,8Z,11Z,14Z-octadecapentaenoic acid;
4,5,8Z,11Z,14Z-nonadecapentaenoic acid;
4,5,8Z,11Z,14Z-heneicosapentaenoic acid;
4,5,8Z,11Z,14Z-doeicosapentaenoic acid;
4,5,8Z,11Z,14Z-trieicosapentaenoic acid;
4,5,8Z-heptadecatrienoic acid;
4,5,8Z-octadecatrienoic acid;
4,5,8Z-eicosatrienoic acid;
4,5,8Z-heneicosatrienoic acid;
4,5,8Z-doeicosatrienoic acid;
4,5,8Z-trieicosatrienoic acid;
8-oxa-3,4-heptadecadienoic acid;
8-oxa-3,4-octadecadienoic acid;
8-oxa-3,4-nonadecadienoic acid;
8-oxa-3,4-eicosadienoic acid;
8-oxa-3,4-heneicosadienoic acid;
8-oxa-3,4-doeicosadienoic acid;
8-oxa-3,4,10Z-heptadecatrienoic acid;
8-oxa-3,4,10Z-octadecatrienoic acid;
8-oxa-3,4,10Z-nonadecatrienoic acid;
8-oxa-3,4,10Z-eicosatrienoic acid;
8-oxa-3,4,10Z-heneicosatrienoic acid;
8-oxa-3,4,10Z-doeicosatrienoic acid;
8-oxa-3,4,10Z,13Z-heptadecatetraenoic acid;
8-oxa-3,4,10Z,13Z-octadecatetraenoic acid;
8-oxa-3,4,10Z,13Z-nonadecatetraenoic acid;
8-oxa-3,4,10Z,13Z-eicosatetraenoic acid;
8-oxa-3,4,10Z,13Z-heneicosatetraenoic acid;
8-oxa-3,4,10Z,13Z-doeicosatetraenoic acid;
7-oxa-3,4-heptadienoic acid;
7-oxa-3,4-octadecadienoic acid;
7-oxa-3,4-nonadecadienoic acid;
7-oxa-3,4-eicosadienoic acid;
7-oxa-3,4-heneicosadienoic acid;
7-oxa-3,4-doeicosadienoic acid;
7-oxa-3,4,10Z-pentadecatrienoic acid;
7-oxa-3,4,10Z-hexadecatrienoic acid;
7-oxa-3,4,10Z-heptadecatrienoic acid;
7-oxa-3,4,10Z-octadecatrienoic acid;
7-oxa-3,4,10Z-nonadecatrienoic acid;
7-oxa-3,4,10Z-eicosatrienoic acid;
7-oxa-3,4,10Z-henoic acidicosatrienoic acid;
7-oxa-3,4,10Z-doeicosatrienoic acid;
7-oxa-3,4,10Z,13Z-heptadecatetraenoic acid;
7-oxa-3,4,10Z,13Z-octadecatetraenoic acid;
7-oxa-3,4,10Z,13Z-nonadecatetraenoic acid;
7-oxa-3,4,10Z,13Z-eicosatetraenoic acid
7-oxa-3,4,10Z,13Z-heneidicosatetraenoic acid;
7-oxa-3,4,10Z,13Z-doeicosatetraenoic acid;
9-oxa-4,5-octadecadienoic acid;
9-oxa-4,5-nonadecadienoic acid;
9-oxa-4,5-eicosadienoic acid;
9-oxa-4,5-heneicosadienoic acid;
9-oxa-4,5-doeicosadienoic acid;
9-oxa-4,5-trieicosadienoic acid;
9-oxa-4,5,11Z-octadecatrienoic acid;
9-oxa-4,5,11Z-nonadecatrienoic acid;
9-oxa-4,5,11Z-eicosatrienoic acid;
9-oxa-4,5,11Z-heneicosatrienoic acid;
9-oxa-4,5,11Z-doeicosatrienoic acid;
9-oxa-4,5,11Z-trieicosatrienoic acid;
9-oxa-4,5,11Z,14Z-octadecatetraenoic acid;
9-oxa-4,5,11Z,14Z-nonadecatetraenoic acid;
9-oxa-4,5,11Z,14Z-eicosatetraenoic acid;
9-oxa-4,5,11Z,14Z-heneicosatetraenoic acid;
9-oxa-4,5,11Z,14Z-doeicosatetraenoic acid;
9-oxa-4,5,11Z,14Z-trieicosatetraenoic acid;
8-oxa-4,5-octadecadienoic acid;
8-oxa-4,5-nonadecadienoic acid;
8-oxa-4,5-eicosadienoic acid;
8-oxa-4,5-henoicosadienoic acid;
8-oxa-4,5-doeicosadienoic acid;
8-oxa-4,5-trieicosadienoic acid;
8-oxa-4,5,11Z-octadecatrienoic acid;
8-oxa-4,5,11Z-nonadecatrienoic acid;
8-oxa-4,5,11Z-eicosatrienoic acid;
8-oxa-4,5,11Z-heneicosatrienoic acid;
8-oxa-4,5,11Z-doeicosatrienoic acid;
3-oxa-4,5,11Z-trieicosatrienoic acid;
8-oxa-4,5,11Z,14Z-octadecatetraenoic acid;
8-oxa-4,5,11Z,14Z-nonadecatetraenoic acid;
8-oxa-4,5,11Z,14Z-eicosatetraenoic acid;
8-oxa-4,5,11Z,14Z-heneicosatetraenoic acid;
8-oxa-4,5,11Z,14Z-doeicosatetraenoic acid; and
8-oxa-4,5,11Z,14Z-trieicosatetraenoic acid.

EXAMPLE VI

A mixture of 376 mg of undecylmercaptan, 438 mg of methyl 7-bromohepta-4,5-dienoate and 0.278 ml of triethyl amine in 2 ml of diethyl ether were stirred at room temperature for 1 hour. The solvent was removed in vacuo and the residue chromatographed on silica gel eluting with hexane and toluene to give 210 mg of methyl 8-thianonadeca-4,5-dienoate having the following NMR spectrum which was run in deutochloroform solution with TMS as the internal standard.

δ0.88 (t, 3H, J=7 Hz, $C_{20}$), 1.2–1.4 (m, 28H, $C_{11}$–$C_{19}$), 1.56 (dt, J=7 Hz, $C_{10}$), 2.29–2.39 (m, 2H, $C_3$), 2.49 (t, 2H, ν=6 Hz, $C_2$), 2.52 (t, 2H, J=7 Hz, $C_9$), 3.09 (dd, 2H, ν=7.6, 2.4, $C_7$) and 5.15–5.22 (m, 2H, $C_4$–$C_6$).

Following the preceeding procedure but substituting the appropriate 1-mercapto compound for undecylmercaptan, and the appropriate dieneoate for 7-bromohepta-4,5-dienoate there may be prepared the following compounds:

methyl 8-thiaoctadeca-4,5,11Z,14Z-tetraenoate;
methyl 8-thiaheptadeca-4,5,11Z,14Z-tetraenoate;
methyl 8-thianonadeca-4,5,11Z,14Z-tetraenoate;
methyl 8-thiaheneicosa-4,5,11Z,14Z-tetraenoate;
methyl 8-thiaeicosa-4,5,11Z,14Z-tetraenoate;
methyl 8-thiatrieicosa-4,5,11Z,14Z-tetraenoate;
methyl 8-thianonadeca-4,5,11Z-trienoate;
methyl 8-thiaoctadeca-4,5,11Z-trienoate;
methyl 8-thiaheptadeca-4,5,11Z,-trienoate;
methyl 8-thiaheneicosa-4,5,11Z,-trienoate;
methyl 8-thiaoctadeca-4,5,-dienoate;
methyl 8-thiaheptadeca-4,5,-dienoate;
methyl 8-thiaheneicosa-4,5,-dienoate;
methyl 8-thiaeicosa-4,5-dienoate
methyl 8-thiatrieicosa-4,5-dienoate
methyl 9-thiaoctadeca-5,6,12Z,15Z-tetraenoate;
methyl 9-thiatrieicosa-5,6,12Z,15Z-tetraenoate;
methyl 9-thiatetraeicosa-5,6,12Z,15Z-tetraenoate;
methyl 9-thianonadeca-5,6,12Z,15Z-tetraenoate;
methyl 9-thiaheneicosa-5,6,12Z,15Z-tetraenoate;
methyl 9-thiaeicosa-5,6,12Z,15Z-tetraenoate;
methyl 9-thianonadeca-5,6,12Z-trienoate;
methyl 9-thiaoctadeca-5,6,12Z-trienoate;
methyl 9-thiatetraeicosa-5,6,12Z-trienoate;
methyl 9-thiatrieicosa-5,6,12Z-trienoate;
methyl 9-thiaheneicosa-5,6,12Z-trienoate;
methyl 9-thiaoctadeca-5,6-dienoate;
methyl 9-thiatetraeicosa-5,6-dienoate;
methyl 9-thiaheneicosa-5,6, -dienoate;
methyl 9-thiahexadeca-5,6-dienoate;
methyl 9-thiaeicosa-5,6-dienoate;
methyl 9-thiatetraeicosa-5,6-dienoate;
methyl 8-thiaoctadeca-4,5,10Z,13Z-tetraenoate;
methyl 8-thiaheptadeca-4,5,10Z,13Z-tetraenoate;
methyl 8-thiahexadeca-4,5,10Z,13Z-tetraenoate;
methyl 8-thianonadeca-4,5,10Z,13Z-tetraenoate;
methyl 8-thiaheneicosa-4,5,10Z,13Z-tetraenoate;
methyl 8-thiaeicosa-4,5,10Z,13Z-tetraenoate;
methyl 8-thianonadeca-4,5,10Z-trienoate;
methyl 8-thiaoctadeca-4,5,10Z-trienoate;
methyl 8-thiaheptadeca-4,5,10Z-trienoate;
methyl 8-thiaeicosa-4,5,10Z-trienoate;
methyl 8-thiahexadeca-4,5,10Z-trienoate;
methyl 8-thiaheneicosa-4,5,10Z-trienoate;
methyl 8-thiaoctadeca-5,6-dienoate;
methyl 8-thiahexadeca-5,6-dienoate;
methyl 8-thiatetraeicosa-5,6-dienoate;
methyl 8-thiaheneicosa-5,6,-dienoate;
methyl 8-thiaeicosa-5,6-dienoate;
methyl 8-thiatrieicosa-5,6-dienoate;
methyl 9-thiaoctadeca-5,6,11Z,14Z-tetraenoate;
methyl 9-thiaheptadeca-5,6,11Z,14Z-tetraenoate;
methyl 9-thiahexadeca-5,6,11Z,14Z-tetraenoate;
methyl 9-thianonadeca-5,6,11Z,14Z-tetraenoate;
methyl 9-thiaheneicosa-5,6,11Z,14Z-tetraenoate;
methyl 9-thiaeicosa-5,6,11Z,14Z-tetraenoate;
methyl 9-thianonadeca-5,6,11Z-trienoate;
methyl 9-thiaoctadeca-5,6,11Z-trienoate;
methyl 9-thiaheptadeca-5,6,11Z-trienoate;
methyl 9-thiaeicosa-5,6,11Z-trienoate;
methyl 9-thiahexadeca-5,6,11Z-trienoate; and
methyl 9-thiaheneicosa-5,6,11Z-trienoate.

EXAMPLE VII

Methyl-8-thianonadeca-4,5-dienoate (210 mg) was treated in 10 ml of ethanol and 1 ml of water with 160 mg of lithium hydroxide at room temperature for 18 hours. The solution was acidified to pH 4 with dilute HCl and extracted with diethyl ether twice. The ethereal extracts were washed with brine and dried over potassium carbonate to give 120 mg of 8-thianonadeca-4,5-dienoic acid. This procedure can be used to convert the compounds of Example VI to their corresponding acid.

EXAMPLE VIII

A solution of 300 mg of 4,5,8Z-eicosatrienoic acid was treated with 0.52 ml of a 20% solution of tetramethylammonium hydroxide in methanol. After stirring for 5 minutes at room temperature the methanol was evaporated under reduced pressure at 30 C. and 5 ml of dimethyl formamide was then added. The resulting suspension was stirred and treated with 0.25 g of methyl iodide. After 30 minutes at room temperature the reaction mixture was diluted with 30 ml of water and extracted with 100 ml of ether. The ethereal solution was washed with water and brine and then dried over sodium sulfate. Evaporation of the ether gave methyl 4,5,8Z-eicosatrienoate.

In a similar fashion, by substitution of the appropriate primary alkyl iodide for methyl iodide, the other alkyl esters can be prepared.

EXAMPLE IX

A solution of 160 mg of methyl 4,5,8Z-eicosatrienoate in 20 ml of ethanol was treated 0.5 ml of 1.0N aqueous potassium hydroxide and the reaction mixture was stirred under nitrogen at room temperature for 7 hours. The solvents were removed under reduced pressure and the resulting oil was dried for several hours at 0.02 mn and 25° C. to give 168 mg of potassium 4,5,8Z-eicosatrienoate.

EXAMPLE X

Assay for Inhibition of Lipoxygenase Activity By Human Polymorphonuclear Leukocytes (PMNs)

1. Preparation of the cells:

The PMNs were prepared from 200–300 ml of heparinized blood of healthy donors not receiving any medication for at least 7 days using Ficoll-Hypaque gradients. In general, PMNs were greater than 98% pure and their viability was assessed by dye-exclusion to be better than 95%. The cells were suspended in phosphate buffered saline containing 1.0 mM $CaCl_2$ (PH 7.4) and 0.1 ovalbumin, and used within 30 minutes.

2. Lipoxygenase Assay:

Incubations were carried out at 37° C. for 5 minutes in a total volume of 0.2 ml. Arachidonic acid 1-$C^{14}$ ($1\times10^{-4}$M unless otherwise indicated, and approximately 300,000 cpm) was added to a suspension of cells (ca $5\times10^{6}$) to initiate the reaction. Prior to the addition of above substrate, the test substances were added to the cells at appropriate concentrations and pre-incubated at 37° C. for 5 minutes. In general, stock solutions of test substances were prepared in ethanol (or other appropriate solvents) and diluted with either incubation buffer or water. The final concentration of ethanol in the incubation did not exceed 2%. Boiled enzyme blanks and controls containing no test compound were always included. The incubations were terminated by the addition of 0.6 ml of methanol, vortexed and kept on ice for 30 minutes. An internal standard (5-hydroxy-7,9,11,14-eicosatetraenoic acid methyl ester) and 1.6 ml of deionized water was added, vortexed, centrifuged, supernatants decanted and kept in the freezer overnight. Extraction and purification of the arachidonic acid and lipoxygenase products were carried out using "Baker" disposable $C_{18}$ extraction columns (1 ml capacity). The columns were prewashed with methanol (2.0 ml) followed by deionized water (2 ml). After most of the solvent was removed, 2.0 ml of the supernatant was applied to the extraction column and the solvent was allowed to flow through. The column was then washed with 5 ml of deionized water and the eludate was discarded. The column was then eluted with 2.0 ml of methanol and the eludate was forced through by $N_2$, collected and the solvent removed in a vacuum oven overnight. The residue was carefully dissolved in 125 ml of the mobile phase (methanol 75:$H_2O$ 25:acetic acid 0.01) and a 10 microliter aliquot counted to estimate the recoveries. An aliquot of an extract from a control tube was injected into a Waters μBondpack C-18 reverse phase column and the retention times of cycloxygenase and lipoxygenase products determined both by OD measurement at 244 nM and by collecting 1 min. fractions and determining radioactivity. Based on this information, programmed collection of fractions (total of 6) using a fraction collector was made with each of the extracts injected into the column by an autoinjector (WISP) and the fractions counted for radioactivity in a Packard Liquid Scintillation Spectrometer. From this data, the percent yields of different products formed and percent inhibition of these by test compounds were calculated.

Using this procedure the following compounds were tested at a concentration of $1\times10^{-4}$ m and found to have the denoted lipoxygenase and cycloxygenase activity:

TABLE I

| | Percent Inhibition | | |
|---|---|---|---|
| | Lipoxygenese Act. | | Cyclooxygenese Act. |
| Compound | 5-HETE[1] | $LTB_4$[2] | Total "PGs" |
| 4,5,8Z-eicosa trienoic acid- | 42 | 47 | 7 |
| 4,5,8Z,11Z,14Z-eicosatetra-enoic acid- | 9 | 20 | 9 |
| 8-thianonadeca-4,5-dienoic acid | 46 | 37 | 22 |

[1]5-hydroxy-7,9,11,14-eicosatetraenoic acid.
[2]Leukotriene $B_4$

Pharmaceutical formulations containing the compounds of this invention may be prepared in accordance with the following non-limiting Examples.

EXAMPLE XI

| Ingredients | Quantity per tablet, mgs. |
|---|---|
| 4,5,8Z,11Z-eicosatetraenoic acid | 25 |
| cornstarch | 20 |
| lactose, spray-dried | 153 |
| magnesium stearate | 2 |

The above ingredients are thoroughly mixed and pressed into single scored tablets.

EXAMPLE XII

| Ingredients | Quantity per tablet, mgs. |
|---|---|
| 4,5,8Z,11Z-eicosatetraenoic acid | 200 |
| cornstarch | 50 |
| lactose | 145 |
| magnesium stearate | 5 |

The above ingredients are mixed intimately and pressed into single scored tablets.

EXAMPLE XIII

| Ingredients | Quantity per tablet, mgs. |
|---|---|
| 4,5,8Z,11Z-eicosatetraenoic acid | 108 |
| lactose | 15 |
| cornstarch | 25 |
| magnesium stearate | 2 |

The above ingredients are mixed and introduced into a hard-shell gelatin capsule.

EXAMPLE XIV

An injectable preparation buffered to a pH of 7 is prepared having the following composition:

| Ingredients | |
|---|---|
| Active ingredient | 0.2 g |
| $KH_2PO_4$ buffer (0.4 M solution) | 2 ml |
| KOH (1 N) | q.s. to pH 7 |
| water (distilled, sterile) | q.s. to 20 ml |

EXAMPLE XV

An oral suspension is prepared having the following composition:

| Ingredients | |
|---|---|
| 4,5,8Z-eicosatrienoic acid | 0.1 g |
| fumaric acid | 0.5 g |
| sodium chloride | 2.0 g |
| methyl paraben | 0.1 g |
| granulated sugar | 25.5 g |
| sorbitol (70% solution) | 12.85 g |
| Veegum K (Vanderbilt Co.) | 1.0 g |
| flavoring | 0.035 ml |
| colorings | 0.5 mg |
| distilled water | q.s. to 100 ml |

What is claimed is:

1. A compound of the formula

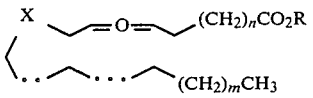

I wherein

R is hydrogen, an alkyl group of 1 to 6 carbon atoms or a pharmaceutically acceptable salt;

X is CH=CH, $CH_2S$, $SCH_2$, or S;

n is 1 or 2 but is 1 when X is CH=CH;

m is 0–6; and the dotted lines represent a single or double bond.

2. The compound of claim 1 wherein X is CH=CH.

3. The compound of claim 2 wherein m is 3.

4. The compound of claim 3 which is 4,5,8Z,11Z,14Z,-eicosapentaenoic acid.

5. The compound of claim 3 which is 4,5,8Z,11Z-eicosatetraenoic acid.

6. The compound of claim 3 which is 4,5,8Z,-eicosatrienoic acid.

7. The compound of claim 1 wherein X is $SCH_2$.

8. The compound of claim 7 wherein m is 3 and n is 1.

9. The compound of claim 8 which is 9-thiaeicosa-4,5-dienoic acid.

10. The compound of claim 8 which is 9-thianonadeca-4,5,11Z,14Z-tetraenoic acid.

11. The compound of claim 1 wherein X is $CH_2S$.

12. The compound of claim 11 wherein m is 3 and n is 1.

13. The compound of claim 12 which is 8-thiaeicosa-4,5-dienoic acid.

* * * * *